US006965202B2

(12) United States Patent
Hataoka et al.

(10) Patent No.: US 6,965,202 B2
(45) Date of Patent: Nov. 15, 2005

(54) HIGH PRESSURE DISCHARGE LAMP AND LAMP UNIT

(75) Inventors: Shinichiro Hataoka, Osaka (JP); Kiyoshi Takahashi, Kyoto (JP); Yuriko Kaneko, Nara (JP); Makoto Horiuchi, Nara (JP); Makoto Kai, Osaka (JP); Tsuyoshi Ichibakase, Osaka (JP); Tomoyuki Seki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 188 days.

(21) Appl. No.: 10/310,381

(22) Filed: Dec. 5, 2002

(65) Prior Publication Data

US 2003/0102805 A1 Jun. 5, 2003

(30) Foreign Application Priority Data

Dec. 5, 2001 (JP) ..... 2001-371365

(51) Int. Cl.[7] ..... H01J 61/20

(52) U.S. Cl. ..... 313/623; 313/624; 313/625; 313/634

(58) Field of Search ..... 313/623–625, 313/493, 634, 636, 244, 317, 318.12; 445/26, 27

(56) References Cited

U.S. PATENT DOCUMENTS

| | | | | |
|---|---|---|---|---|
| 4,550,269 A | | 10/1985 | Dixon | |
| 5,109,181 A | | 4/1992 | Fischer et al. | |
| 5,138,229 A | * | 8/1992 | Honda et al. | 313/628 |
| 5,468,168 A | | 11/1995 | Balaschak et al. | |
| 5,598,063 A | | 1/1997 | Mathews et al. | |
| 6,137,228 A | | 10/2000 | Aizawa et al. | |
| 6,271,628 B1 | | 8/2001 | Sugitani et al. | |
| 6,486,603 B1 | * | 11/2002 | Ikeuchi et al. | 313/639 |
| 6,762,559 B1 | * | 7/2004 | Ishikawa et al. | 313/639 |
| 2002/0000777 A1 | | 1/2002 | Horiuchi et al. | |
| 2002/0047611 A1 | | 4/2002 | Kaneko et al. | |

FOREIGN PATENT DOCUMENTS

| | | | |
|---|---|---|---|
| EP | 0 903 771 A2 | 3/1999 | |
| JP | 49-071780 | 7/1974 | |
| JP | 54-39973 | 3/1979 | |
| JP | 62-262355 | * 11/1987 | H01J/61/073 |
| JP | 2-148561 | 6/1990 | |
| JP | 06-089703 | 3/1994 | |
| JP | 06208831 A | 7/1994 | |
| JP | 06-223781 | 8/1994 | |
| JP | 07-050153 | 2/1995 | |

(Continued)

OTHER PUBLICATIONS

"VYCOR Brand Porous Glass 7930", Corning Inc., 2001.*

U.S. Appl. No. 10/111,067, filed Apr. 18, 2002, Horiuchi et al.

Notice of Reasons of Rejection and English Translation for Application No. 2002–351523; Mailing Date: Jun. 17, 2003; Japanese Patent Office.

*Primary Examiner*—Joseph Williams
*Assistant Examiner*—Sharlene Leurig
(74) *Attorney, Agent, or Firm*—Harness, Dickey & Pierce, P.L.C.

(57) ABSTRACT

A high pressure discharge lamp includes a luminous bulb enclosing a luminous substance therein; and a sealing portion for retaining airtightness of the luminous bulb. The sealing portion has a first glass portion extending from the luminous bulb and a second glass portion provided at least in a portion inside the first glass portion, and the sealing portion has a portion to which a compressive stress is applied.

24 Claims, 31 Drawing Sheets

(1 of 31 Drawing Sheet(s) Filed in Color)

FOREIGN PATENT DOCUMENTS

| | | | |
|---|---|---|---|
| JP | 07-296781 | | 11/1995 |
| JP | 08-250064 | | 9/1996 |
| JP | 09165641 | A | 6/1997 |
| JP | 10-106492 | | 4/1998 |
| JP | 10-255720 | | 9/1998 |
| JP | 10-269941 | | 10/1998 |
| JP | 11-096969 | | 4/1999 |
| JP | 11162409 | A | 6/1999 |
| JP | 11-260315 | A | 9/1999 |
| JP | 11-297268 | | 10/1999 |
| JP | 11329350 | A | 11/1999 |
| JP | 2000-011955 | | 1/2000 |
| JP | 2000195468 | A | 7/2000 |
| JP | 2000315456 | A | 11/2000 |
| JP | 2001-015067 | | 1/2001 |
| JP | 2001-023570 | A | 1/2001 |
| JP | 2001023571 | A | 1/2001 |
| JP | 2001-102005 | | 4/2001 |
| JP | 2001-118542 | A | 4/2001 |
| JP | 2001160375 | A | 6/2001 |
| JP | 2002-151002 | | 5/2002 |
| JP | 2002-208377 | | 7/2002 |
| JP | 2002270133 | A | 9/2002 |
| JP | 2003-151497 | | 5/2003 |
| WO | WO 01/29862 | A1 | 4/2001 |

* cited by examiner

HIGH PRESSURE DISCHARGE LAMP AND LAMP UNIT

BACKGROUND OF THE INVENTION

The present invention relates to a high pressure discharge lamp and a lamp unit. In particular, the present invention relates to a high pressure discharge lamp used for general illumination, projectors in combination with a reflecting mirror, headlights of automobiles or the like.

In recent years, an image projecting apparatus such as a liquid crystal projector and a DMD projector is commonly used as a system for realizing large-scale video images, and in general, a high pressure discharge lamp having a high intensity is commonly used for such an image projecting apparatus. FIG. 40 is a schematic view showing the structure of a conventional high pressure discharge lamp 1000. The lamp 1000 shown in FIG. 40 is a so-called superhigh pressure mercury lamp is disclosed, for example, in Japanese Laid-Open Patent Publication No. 2-148561.

The lamp 1000 includes a luminous bulb (arc tube) 101 made of quartz glass and a pair of sealing portions (seal portions) 102 extending from both ends of the luminous bulb 101. A luminous material (mercury) 106 is enclosed inside (in a discharge space) of the luminous bulb 101, and a pair of tungsten electrodes (W electrodes) 103 made of tungsten are opposed with a predetermined distance. A molybdenum foil (Mo foil) 104 in the sealing portion 102 is welded to one end of the W electrode 103, and the W electrode 103 and the Mo foil 104 are electrically connected. An external lead (Mo rod) 105 made of molybdenum is electrically connected to one end of the Mo foil 104. Argon (Ar) and a small amount of halogen, in addition to the mercury 106, are enclosed in the luminous bulb 101.

The operational principle of the lamp 1000 will be described below. When a start voltage is applied between the W electrodes 103 via the external leads 105 and the Mo foils 104, discharge of argon (Ar) occurs, and this discharge increases the temperature in the discharge space of the luminous bulb 101, and then the mercury 106 is heated and evaporated. Therefore, mercury atoms are exited in the central portion of an arc between the W electrodes 103 and thus light is emitted. The higher the mercury vapor pressure of the lamp 1000 is, the more light is radiated, so that the higher mercury vapor pressure is more suitable for the light source of an image projecting apparatus, but in view of the physical strength against pressure of the luminous bulb 110, the lamp 1000 is used at a mercury vapor pressure of 15 to 20 MPa (150 to 200 atm).

The conventional lamp 1000 has a strength against a pressure of about 20 MPa. In order to further improve the lamp characteristics, research and development are conducted to further enhance the strength against pressure (e.g., see Japanese Laid-Open Patent Publication No.2001-23570). This is because there is a demand for a higher output and power lamp to realize a higher performance image projecting apparatus, and thus there is a demand for a lamp having a high strength against pressure in order to meet this demand.

Further describing this point, in the case of a high output and power lamp, in order to suppress evaporation of the electrodes from being facilitated by an increase of current, it is necessary to enclose a higher amount of mercury than usual so as to increase the lamp voltage. If the amount of mercury enclosed is insufficient relatively to the lamp power, the lamp voltage cannot be increased to a necessary level, so that the lamp current increases. As a result, the electrodes are evaporated in a short time, and therefore a practical lamp cannot be achieved. In other words, what should be done in order to realize a high power lamp is only to increase the lamp power and to produce a short-arc type lamp whose interelectrode distance is shorter than a conventional lamp. However, in order to produce a high output and high power lamp in practice, it is necessary to improve the strength against pressure to increase the amount of mercury enclosed. Current techniques have not succeeded in realizing a high pressure discharge lamp having a very high strength against pressure (e.g., about 30 MPa or more) that can be used in practice.

SUMMARY OF THE INVENTION

Therefore, with the foregoing in mind, it is a main object of the present invention to provide a high pressure discharge lamp having a higher strength against pressure than that of conventional high pressure discharge lamps.

A first high pressure discharge lamp of the present invention includes a luminous bulb enclosing a luminous substance therein; and a sealing portion for retaining airtightness of the luminous bulb. The sealing portion has a first glass portion extending from the luminous bulb and a second glass portion provided at least in a portion inside the first glass portion, and the sealing portion has a portion to which a compressive stress is applied.

The portion to which a compressive stress is applied may be one selected from the group consisting of the second glass portion, a boundary portion of the second glass portion and the first glass portion, a portion of the second glass portion on the side of the first glass portion, and a portion of the first glass portion on the side of the second glass portion.

A strain boundary region caused by a difference in compressive stress between the first glass portion and the second glass portion may be present in the vicinity of the boundary of the two glass portions.

It is preferable that a metal portion for supplying power that is in contact with the second glass portion is provided in the sealing portion.

The compressive stress may be applied at least in the longitudinal direction of the sealing portion.

It is preferable that the first glass portion contains 99 wt % or more of $SiO_2$, and the second glass portion contains $SiO_2$ and at least one of 15 wt % or less of $Al_2O_3$ and 4 wt % or less of B.

It is preferable that the softening point of the second glass portion is lower than that of the first glass portion.

It is preferable that the second glass portion is formed of a glass tube.

It is preferable that the second glass portion is not formed by compressing and sintering glass powder.

In one preferable embodiment, a pair of the sealing portions extend from the luminous bulb, each of the pair of sealing portions has the first glass portion and the second glass portion, and each of the pair of sealing portions has a portion to which a compressive stress is applied.

In one preferable embodiment, the compressive stress in the portion to which the compressive stress is applied is about 10 kgf/cm$^2$ or more and about 50 kgf/cm$^2$ or less.

In one preferable embodiment, the difference in the compressive stress is about 10 kgf/cm$^2$ or more and about 50 kgf/cm$^2$ or less.

In one preferable embodiment, a pair of electrode rods are opposed in the luminous bulb, at least one of the pair of electrode rods is connected to a metal foil, and the metal foil is provided in the sealing portion, and at least a portion of the metal foil is positioned in the second glass portion.

In one preferable embodiment, at least mercury is enclosed in the luminous bulb as the luminous substance, and the amount of the mercury enclosed is 300 mg/cc or more.

In one preferable embodiment, the high pressure discharge lamp is a high pressure mercury lamp having an average color rendering index Ra of more than 65.

It is preferable that the color temperature of the high pressure mercury lamp is 8000 K or more.

The high pressure discharge lamp may be a metal halide lamp containing at least a metal halide as the luminous substance.

A second high pressure discharge lamp of the present invention includes a luminous bulb in which a pair of electrode rods are disposed in the inside of the bulb; and a pair of sealing portions for retaining airtightness of the luminous bulb that extend from the luminous bulb. A portion of each of the pair of electrode rods is buried in a corresponding sealing portion of the pair of sealing portions. The sealing portion has a first glass portion extending from the luminous bulb and a second glass portion provided at least in a portion inside the first glass portion. At least one of the sealing portions has a portion to which a compressive stress is applied. The portion to which the compressive stress is applied is one selected from the group consisting of the second glass portion, a boundary portion of the second glass portion and the first glass portion, a portion of the second glass portion on the side of the first glass portion, and a portion of the first glass portion on the side of the second glass portion. The compressive stress at least in the longitudinal direction of the sealing portion is present in the second glass portion. A metal film made of at least one metal selected from the group consisting of Pt, Ir, Rh, Ru, and Re is formed on a surface of at least a portion of the electrode rod that is buried in the at least one of the sealing portions.

A third high pressure discharge lamp of the present invention includes a luminous bulb in which a pair of electrode rods are disposed in the inside of the bulb; and a pair of sealing portions for retaining airtightness of the luminous bulb that extend from the luminous bulb. A portion of each of the pair of electrode rods is buried in a corresponding sealing portion of the pair of sealing portions. At least one of the pair of sealing portions has a first glass portion extending from the luminous bulb and a second glass portion provided at least in a portion inside the first glass portion. The at least one of the sealing portions has a portion to which a compressive stress is applied. The portion to which the compressive stress is applied is one selected from the group consisting of the second glass portion, a boundary portion of the second glass portion and the first glass portion, a portion of the second glass portion on the side of the first glass portion, and a portion of the first glass portion on the side of the second glass portion. A coil having at least one metal selected from the group consisting of Pt, Ir, Rh, Ru, and Re on at least its surface thereof is wound around at least a portion of the electrode rod that is buried in the at least one of the sealing portions.

In one preferable embodiment, each of the pair of electrode rods is connected to a metal foil provided inside a corresponding sealing portion of the pair of sealing portions, and at least a portion of the metal foil provided inside the at least one of the sealing portions is positioned in the second glass portion.

In one preferable embodiment, the second glass portion contains $SiO_2$ and at least one of 15 wt % or less of $Al_2O_3$ and 4 wt % or less of B, the first glass portion contains 99 wt % or more of $SiO_2$, the softening point of the second glass portion is lower than that of the first glass portion, and the second glass portion is not formed by compressing and sintering glass powder.

In one preferable embodiment, the compressive stress in the portion to which the compressive stress is applied is about 10 kgf/cm$^2$ or more and about 50 kgf/cm$^2$ or less.

In one preferable embodiment, at least mercury is enclosed in the luminous bulb as the luminous substance, and the amount of the mercury enclosed is 300 mg/cc or more.

In one preferable embodiment, the high pressure discharge lamp may be a metal halide lamp containing at least a metal halide as the luminous substance.

A high pressure discharge lamp in one embodiment includes a translucent airtight container, a pair of electrodes provided in the airtight container, a pair of sealing portions coupled to the airtight container. At least one of the pair of sealing portions includes a first glass portion extending from the airtight container and a second glass portion provided at least in a portion inside the first glass portion. A compressive stress at least in the longitudinal direction of the sealing portion is present in the second glass portion. Mercury is substantially not enclosed in the airtight container, and a first halogenide, a second halogenide and a rare gas are enclosed in the airtight container. The metal of the first halogenide is a luminous substance, and the second halogenide has a larger vapor pressure than that of the first halogenide, and is a halogenide of one or more metals that emit light in a visible light region with more difficulty than the metal of the first halogenide.

A high pressure discharge lamp in one embodiment includes a translucent airtight container, a pair of electrodes provided in the airtight container, a pair of sealing portions extending from the airtight container. At least one of the pair of sealing portions includes a first glass portion extending from the airtight container and a second glass portion provided at least in a portion inside the first glass portion. A compressive stress at least in the longitudinal direction of the sealing portion is present in the second glass portion. Mercury is substantially not enclosed in the airtight container, and a first halogenide, a second halogenide and a rare gas are enclosed in the airtight container. The first halogenide is a halogenide of one or more metals selected from the group consisting of sodium, scandium, and rare earth metals. The second halogenide has a relatively larger vapor pressure and is a halogenide of one or more metals that emit light in a visible light region with more difficulty than the metal of the first halogenide.

A first method for producing a high pressure discharge lamp of an embodiment of the present invention includes preparing a glass pipe for a discharge lamp including a luminous bulb portion that will be formed into a luminous bulb of a high pressure discharge lamp and a side tube portion extending from the luminous bulb portion; inserting a glass tube into the side tube portion and beating the side tube portion to attach the two components; inserting an electrode structure including at least electrode rods into the glass tube attached to the side tube portion; and then heating and shrinking (contracting) the side tube portion and the glass tube so as to seal the electrode structure.

A second method for producing a high pressure discharge lamp of an embodiment of the present invention includes inserting an electrode structure including at least electrode rods in a glass tube; attaching a portion of the glass tube and at least a portion of the electrode structure; inserting the glass tube attached to at least a portion of the electrode structure into a side tube portion in a glass pipe for a discharge lamp including a luminous bulb portion that will be formed into a luminous bulb of the high pressure discharge lamp and a side tube portion extending from the luminous bulb portion; and then heating and shrinking the side tube portion and the glass tube so as to seal the electrode structure.

In one preferable embodiment, the side tube portion contains 99 wt % or more of $SiO_2$, and the glass tube contains $SiO_2$ and at least one of 15 wt % or less of $Al_2O_3$ and 4 wt % or less of B.

It is preferable that the softening point of the glass tube is lower than that of the side tube portion.

In one preferable embodiment, the process of sealing the electrode structure is performed so that a compressive stress of about 10 kgf/cm$^2$ or more and about 50 kgf/cm$^2$ or less occurs in a portion selected from the group consisting of the glass tube, a boundary portion of the glass tube and the side tube portion, a portion of the glass tube on the side of the side tube portion, and a portion of the side tube portion on the side of the glass tube at least in the longitudinal direction of the side tube portion.

In one preferable embodiment, the process of sealing the electrode structure is performed and the sealing portion of a high pressure discharge lamp is completed, and then the sealing portion is heated, so that that a compressive stress of about 10 kgf/cm$^2$ or more and about 50 kgf/cm$^2$ or less is generated in a portion of the sealing portion.

After the process of sealing the electrode structure is performed and the sealing portion of a high pressure discharge lamp is completed, it is preferable to further perform the process of heating the sealing portion at a temperature hither than the strain point temperature of the glass tube for two or more hours.

In one preferable embodiment, the electrode structure includes the electrode rod, a metal foil connected to the electrode rod, and an external lead connected to the metal foil.

In one preferable embodiment, a metal film made of at least one metal selected from the group consisting of Pt, Ir, Rh, Ru, and Re is formed at least in a portion of the electrode rod.

In one preferable embodiment, a coil having at least one metal selected from the group consisting of Pt, Ir, Rh, Ru, and Re at least on its surface is wound around at least a portion of the electrode rod.

In one preferable embodiment, a portion having a small diameter in which the inner diameter of the side tube portion is smaller than that of other portions is provided in the vicinity of the boundary of the side tube portions and the luminous bulb portion in the glass pipe for a discharge lamp.

A high pressure discharge lamp of one embodiment of the present invention includes a component obtained in the following manner. A side tube portion extending from a luminous bulb portion that will be formed into a luminous bulb of a high pressure discharge lamp and a glass tube inserted into the side tube portion are heated and attached and thus a sealing portion is formed. The sealing portion is subjected to an annealing treatment at a temperature higher than the strain point temperature of the glass tube and lower than the strain point temperature of the glass constituting the side tube portion.

A fourth high pressure discharge lamp of the present invention includes a luminous bulb enclosing a luminous substance therein; and a sealing portion for retaining airtightness of the luminous bulb. The sealing portion has a first glass portion extending from the luminous bulb and a second glass portion provided at least in a portion inside the first glass portion. When a strain measurement is performed by a sensitive color plate method utilizing a photoelasticity effect is performed, a compressive stress is observed at least in a portion of a region corresponding to the second glass portion of the sealing portion.

The strain measurement can be performed with a strain detector of SVP-200 manufactured by Toshiba Cooperation.

An incandescent lamp in one embodiment of the present invention includes a bulb enclosing a luminous substance therein and a sealing portion for retaining airtightness in the bulb. The sealing portion includes a first glass portion extending from the bulb and, a second glass portion provided at least in a portion inside the first glass portion. The sealing portion has a portion to which a compressive stress is applied.

A lamp unit of the present invention includes the above-described high pressure discharge lamp and a reflecting mirror for reflecting light emitted from the high pressure discharge lamp.

In a high pressure discharge lamp of the present invention, the sealing portion has a first glass portion extending from a luminous bulb, and a second glass portion provided at least in a portion inside the first glass portion, and the sealing portion has a portion to which a compressive stress is applied. The presence of the portion to which a compressive stress is applied improves the strength against pressure of the high pressure discharge lamp.

When a metal film made of at least one metal selected from the group consisting of Pt, Ir, Rh, Ru, and Re is formed on a surface of at least a portion of the electrode rod that is buried in at least one of the sealing portions, the wettability between the surface of the electrode rod and the glass of the sealing portion becomes poor. Therefore, in the lamp production process, the two components can be easily detached. As a result, it is possible to prevent small cracks from occurring and to improve the strength against pressure of the lamp further. Also when a coil having at least one metal selected from the group consisting of Pt, Ir, Rh, Ru, and Re on at least its surface is wound around at least a portion of the electrode rod that is buried at least in one of the sealing portions, it is possible to prevent small cracks from occurring and to improve the strength against pressure of the lamp further.

The present invention can be applied not only to a high pressure mercury lamp, but also other high pressure discharge lamps such as a metal halide lamp and a xenon lamp, and can be applied to a mercury-free metal halide lamp that does not contain mercury. A mercury-free metal halide lamp according to the present invention has a high strength against pressure, so that a rare gas can be enclosed to a high pressure. As a result, the efficiency can be improved in a simple manner, and the operation start properties can be improved. The present invention can be applied not only to a high pressure mercury lamp, but also an incandescent lamp (e.g., halogen incandescent lamp), and can make the possibility of breakage lower than in conventional incandescent lamps.

According to the present invention, the sealing portion has a first glass portion extending from a luminous bulb, and a second glass portion provided at least in a portion inside the first glass portion, and the sealing portion has a portion to which a compressive stress is applied. Thus, the presence of the portion to which a compressive stress is applied provides a high pressure discharge lamp having an improved strength against pressure.

BRIEF DESCRIPTION OF THE DRAWINGS

The file of this patent contains at least one drawing executed in color. Copies of this patent with color drawings will be provided by the Patent and Trademark Offic upon request and payment of necessary fee.

DETAILED DESCRIPTION OF THE INVENTION

Figure 1A:
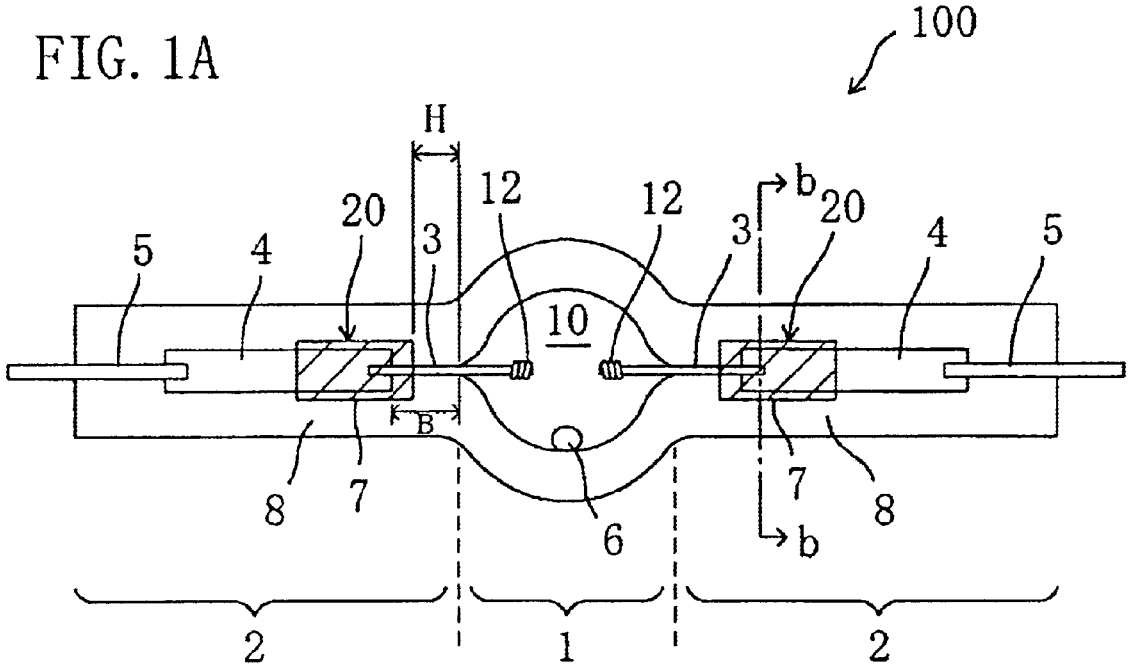
FIGS. 1A and 1B are schematic cross-sectional views showing the structure of a high pressure discharge lamp 100 of an embodiment of the present invention.

Hereinafter, embodiments of the present invention will be described with reference to the accompanying drawings. In the following drawings, for simplification of description, the elements having substantially the same function bear the same reference numeral. The present invention is not limited to the following embodiments.

Embodiment 1

Figure 1B:
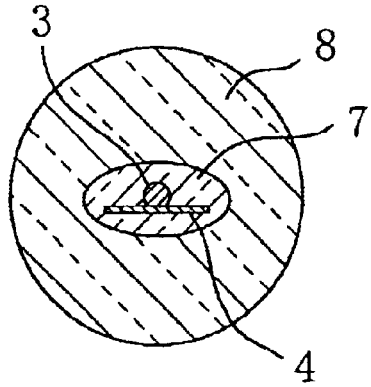

FIGS. 1A and 1B are schematic views showing the structure of a lamp 100 of this embodiment. The lamp 100 of this embodiment is a high pressure discharge lamp including a luminous bulb 1 and sealing portions 2 extending from the luminous bulb 1. The lamp shown in FIG. 1 is a high pressure mercury lamp. FIG. 1A schematically shows the entire structure of the lamp 100, and FIG. 1B schematically shows the cross-sectional structure of the sealing portion 2 taken along line b—b in FIG. 1A when viewed from the side of the luminous bulb 1.

The sealing portion 2 of the lamp 100 is a portion for retaining airtightness of the internal portion 10 of the luminous bulb 1, and the lamp 100 is a double end type lamp provided with two sealing portions 2. The sealing portion 2 includes a first glass portion (side tube portion) 8 extending from the luminous bulb 1 and a second glass portion 7 provided at least in a portion inside (on the side of the center) of the first glass portion 8. The sealing portion 2 has a portion (7) to which a compressive stress is applied, and in this embodiment, the portion to which a compressive stress is applied corresponds to the second glass portion 7. The cross-sectional shape of the sealing portion 2 is substantially circular, as shown in FIG. 1B, and a metal portion 4 for supplying lamp power is provided in the sealing portion 2. A part of the metal portion 4 is in contact with the second glass portion 7, and in this embodiment, the metal portion 4 is positioned in the central portion of the second glass portion 7. The second glass portion 7 is positioned in the central portion of the sealing portion 2, and the outer circumference of the second glass portion 7 is covered with the first glass portion 8.

The lamp 100 of this embodiment is measured regarding strain by a sensitive color plate method utilizing photoelastic effect. When the sealing portion 2 is observed, it is confirmed that a compressive stress is present in the portion corresponding to the second glass portion 7. In the strain measurement by a sensitive color plate method, strain (stress) in the internal portion of the cross section obtained by cutting the sealing portion 2 cannot be observed while the shape of the lamp 100 is maintained. However, the fact that a compressive stress is observed in the portion corresponding to the second glass portion 7 means that a compressive stress is applied in a portion of the sealing portion 2 in one of the following states or a combination thereof a compressive stress is applied to the entire or the major portion of the second glass portion 7; a compressive stress is applied to the boundary portion between the second glass portion 7 and the first glass portion 8; a compressive stress is applied to a portion of the second glass portion 7 on the side of the first glass portion 8; and a compressive stress is applied to a portion of the first glass portion 8 on the side of the second glass portion 7. In this measurement, a stress (or strain) that is compressive in the longitudinal direction of the sealing portion 2 is monitored in the form of an integrated value.

The first glass portion 8 in the sealing portion 2 contains 99 wt % or more of $SiO_2$, and is made of, for example, quartz glass. On the other hand, the second glass portion 7 contains $SiO_2$ and at least one of 15 wt % or less of $Al_2O_3$ and 4 wt % or less of B, and is made of, for example, Vycor glass. When $Al_2O_3$ or B is added to $SiO_2$, the softening point of glass is decreased, so that the softening point of the second glass portion 7 is lower than that of the first glass portion 8. The Vycor glass (product name) is glass obtained by mixing additives to quartz glass to decrease the softening point so as to improve the processability of quartz glass. For example, the Vycor glass can be produced by subjecting borosilicate glass to a thermal and chemical treatment so as to have the characteristics similar to those of quartz. The composition of the Vycor glass is as follows, for example: 96.5 wt % of silica ($SiO_2$); 0.5 wt % of alumina ($Al_2O_3$); and 3 wt % of boron (B). In this embodiment, the second glass portion 7 is formed of a glass tube made of Vycor glass. The glass tube made of Vycor glass can be replaced by a glass tube containing 62 wt % of $SiO_2$, 13.8 wt % of $Al_2O_3$, and 23.7 wt % of CuO.

The compressive stress applied to a portion of the sealing portion 2 can be substantially beyond zero (i.e., 0 kgf/cm$^2$). It should be noted that this compressive stress is one in a state in which a lamp is not operated. The presence of the compressive stress can improve the strength against pressure of the conventional structure. It is preferable that the compressive stress is about 10 kgf/cm$^2$ or more, (about $9.8\times10^5$ N/m$^2$ or more) and about 50 kgf/cm$^2$ or less, (about $4.9\times10^6$ N/m$^2$ or less). When it is less than 10 kgf/cm$^2$, the compressive strain is weak, so that the strength against pressure of the lamp may not be increased sufficiently. There is no practical glass materials that can realize a structure having a compressive stress higher than about 50 kgf/cm$^2$. However, a compressive stress of less than 10 kgf/cm$^2$ can increase the strength against pressure of the conventional structure, as long as it exceeds substantially zero. If a practical material that can realize a structure having a compressive stress of more than 50 kgf/cm$^2$ is developed, the second glass portion 7 can have a compressive stress of more than 50 kgf/cm$^2$.

It seems that a strain boundary region 20 created by the difference in the compressive stress between the first glass portion 8 and second glass portion 7 is present in the vicinity of the boundary between the first glass portion 8 and the second glass portion 7, judging from the results of the observation of the lamp 100 with a strain detector. Accordingly, it seems that the compressive strain is present exclusively in the second glass portion 7 (or an area near the outer circumference of the second glass portion 7), and the compressive strain of the second glass portion 7 is not transmitted very much (or is hardly transmitted) to the entire first glass portion 8. The difference in the compressive stress between the first glass portion 8 and the second glass portion 7 can be in the range, for example, from about 10 kgf/cm$^2$ to about 50 kgf/cm$^2$.

The luminous bulb 1 of the lamp 100 is substantially spherical, and is made of quartz glass, as in the case of the first glass portion 8. In order to realize a high pressure mercury lamp (in particular, superhigh pressure mercury lamp), it is preferable to use high purity quartz glass having a low level of alkali metal impurities (e.g., 1 ppm or less) as the quartz glass constituting the luminous bulb 1. It is of course possible to use quartz glass having a regular level of alkali metal impurities. The outer diameter of the luminous bulb 1 is, for example, about 5 mm to 20 mm. The thickness of the glass of the luminous bulb 1 is, for example, about 1 mm to 5 mm. The volume of the discharge space 10 in the luminous bulb 1 is, for example, about 0.01 to 1 cc (0.01 to 1 cm$^3$). In this embodiment, a luminous bulb 1 having an outer diameter of about 9 mm, an inner diameter of about 4 mm, and a volume of the discharge space of about 0.06 cc.

A pair of electrode rods (electrodes) 3 are opposed in the luminous bulb 1. The heads of the electrode rods 3 are disposed in the luminous bulb 1 with a distance D (arc length) of about 0.2 to 5 mm (e.g., 0.6 mm to 1.0 mm), and each of the electrode rods 3 is made of tungsten (W). A coil 12 is wound around the head of the electrode rod 3 for the purpose of reducing the temperature of the head of the electrode during lamp operation. In this embodiment, a coil made of tungsten is used as the coil 12, but a coil made of thorium—tungsten can be used. Similarly, for the electrode rod 3, not only a tungsten rod, but also a rod made of thorium—tungsten can be used.

Mercury 6 is enclosed in the luminous bulb 1 as a luminous material. To operate the lamp 100, which is a superhigh pressure mercury lamp, about at least 200 mg/cc or more (220 mg/cc or more, 230 mg/cc or more, or 250 mg/cc or more), preferably 300 mg or more (e.g., 300 mg/cc to 500 mg/cc) of mercury, a rare gas (e.g., argon) at 5 to 30 kPa, and, if necessary, a small amount of halogen is enclosed in the luminous bulb 1.

The halogen enclosed in the luminous bulb 1 serves for the halogen cycles that returns W (tungsten) evaporated from the electrodes rod 3 during lamp operation to the electrode rod 3 again. For example, bromine can be used. The enclosed halogen can be in the form of a halogen precursor (form of a compound), instead of the form of a single substance, and in this embodiment, halogen in the form of $CH_2Br_2$ is introduced into the luminous bulb 1. The amount of $CH_2Br_2$ is about 0.0017 to 0.17 mg/cc. This corresponds to about 0.01 to 1 $\mu$mol/cc in terms of the halogen atom density during lamp operation. The withstand pressure (operating pressure) of the lamp 100 can be 20 MPa or more (e.g., about 30 to 50 MPa or more). Moreover, the bulb wall load can be, for example, about 60 W/cm$^2$ or more, and the upper limit is not provided. For example, a lamp having a bulb wall load, for example, in the range from about 60 W/cm$^2$ to 300 W/cm$^2$ (preferably about 80 to 200 W/cm$^2$) can be realized. If cooling means are provided, a bulb wall load of 300 W/cm$^2$ or more can be achieved. The rated power is, for example, 150 W (the bulb wall load in this case corresponds to about 130 W/cm$^2$).

The electrode rod 3 one end of which is positioned in the discharge space 10 is connected to the metal foil 4 provided in the sealing portion 2 by welding, and at least a part of the metal foil 4 is positioned in the second glass portion 7. In the structure shown in FIG. 1, a portion including a connection portion of the electrode rod 3 and the metal foil 4 is covered with the second glass portion 7. The sizes of the second glass portion 7 in the structure shown in FIG. 1 are as follows, for example: The length of the sealing portion 2 in the longitudinal direction is about 2 to 20 mm (e.g., 3 mm, 5 mm and 7 mm), and the thickness of the second glass portion 7 sandwiched between the first glass portion 8 and the metal foil 4 is about 0.01 to 2 mm (e.g., 0.1 mm). The distance H from the end face of the second glass portion 7 on the side of the luminous bulb 1 to the discharge space 10 of the luminous bulb 1 is about 0 mm to about 6 mm (e.g., 0 mm to about 3 mm or 1 mm to 6 mm). When the second glass portion 7 is not desired to be exposed into the discharge space 10, the distance H is larger than 0 mm, and for example, 1 mm or more. The distance B from the end face of the metal foil 4 on the side of luminous bulb 1 to the discharge space 10 of the luminous bulb 1 (in other words, the length of the portion of the electrode rod 3 that is buried in the sealing portion 2) is, for example, about 3 mm.

As described above, the cross-sectional shape of the sealing portion 2 is substantially circular, and the metal foil 4 is provided substantially in the central portion thereof. The metal foil 4 is, for example, a rectangular molybdenum foil (Mo foil), and the width of the metal foil 4 (the length on the side of the shorter side) is, for example, about 1.0 mm to 2.5 mm (preferably, about 1.0 mm to 1.5 mm). The thickness of the metal foil 4 is, for example, about 15 $\mu$m to 30 $\mu$m (preferably about 15 $\mu$m to 20 $\mu$m). The radio of the thickness and the width is about 1:100. The length of the metal foil 4 (the length on the side of the longer side) is, for example, about 5 mm to 50 mm.

An external lead 5 is provided by welding on the side opposite to the side on which the electrode rod 3 is positioned. The external lead 5 is connected to the metal foil 4 on the side opposite to the side to which the electrode rod 3 is connected, and one end of the external lead 5 is extending to the outside of the sealing portion 2. The external lead 5 is electrically connected to a ballast circuit (not shown) so as to connect electrically the ballast circuit and the pair of electrode rods 3. The glass portions (7, 8) and the metal foil 4 are attached by pressing against each other so that the sealing portion 2 serves to retain the airtightness in the discharge space 10 in the luminous bulb 1. The sealing mechanism of the sealing portion 2 will be described briefly below.

The thermal expansion coefficient is different between the material constituting the glass portion of the sealing portion 2 and molybdenum constituting the metal foil 4. Therefore, in view of the thermal expansion coefficient, the glass portion and the metal foil 4 are not integrated into one unit. However, in the case of this structure (foil sealing), the metal foil 4 is plastically deformed by the pressure from the glass portion of the sealing portion, so that the gap between them can be buried. Thus, the glass portion of the sealing portion 2 and the metal foil 4 can be attached, and thus the luminous bulb 1 can be sealed with the sealing portion 2. That is to say, foil sealing by pressing the glass portion of the sealing portion 2 against the metal foil 4 so as to achieve attachment, the sealing portion 2 is sealed. In this embodiment, since the second glass portion 7 having a compressive strain is provided, the reliability of this sealing structure is improved.

Figure 2A:
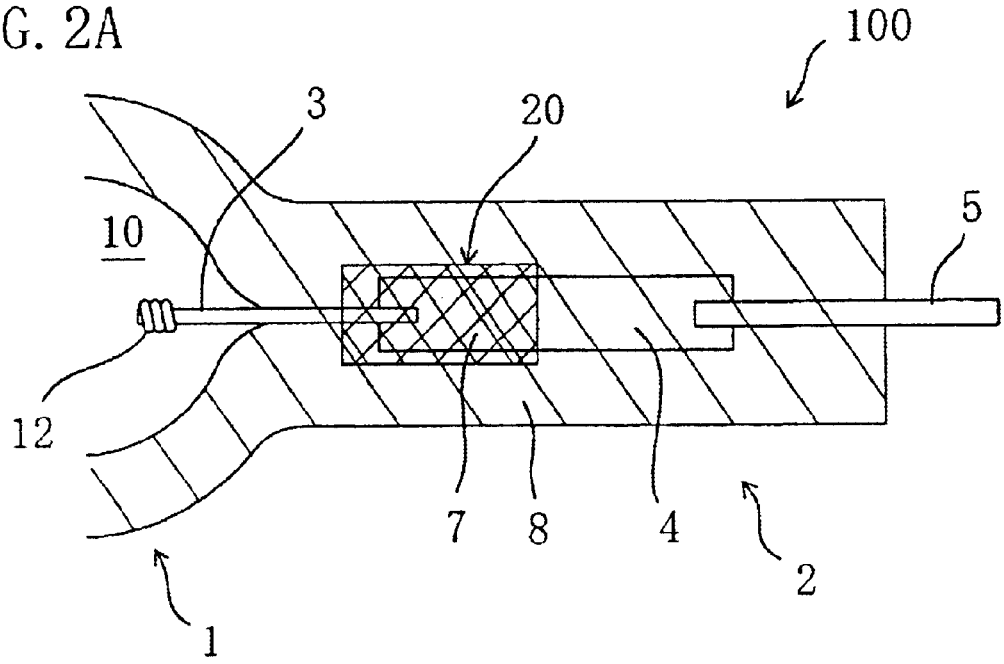
FIGS. 2A and 2B are enlarged views of the principal part showing the distribution of compressive strain along the longitudinal direction (electrode axis direction) of a sealing portion 2.
Figure 2B:
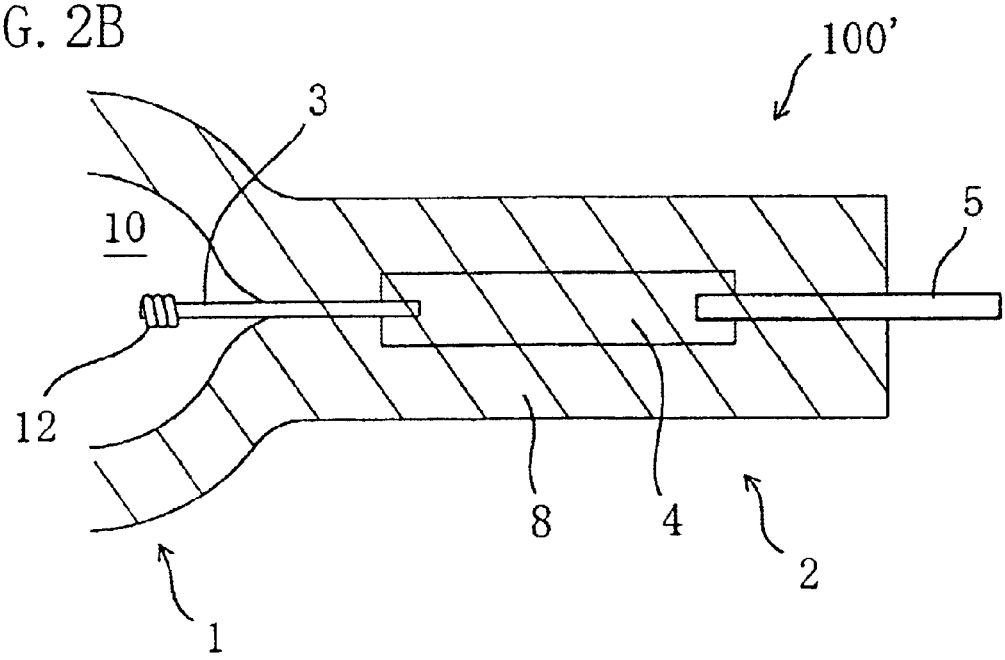

Next, the compressive strain in the sealing portion 2 will be described. FIGS. 2A and 2B are schematic views showing the distribution of the compressive strain along the longitudinal direction (direction of the electrode axis) of the sealing portion 2, and FIG. 2A shows the distribution in the structure of the lamp 100 provided with the second glass portion 7, and the FIG. 2B shows the distribution in the structure of the lamp 100' that is not provided with the second glass portion 7 (comparative example).

A compressive stress (compressive strain) is present in a region (cross-hatched region) corresponding to the second glass portion 7 of the sealing portion 2 shown in FIG. 2A, and the magnitude of the compressive stress in the portion (hatched region) of the first glass portion 8 is substantially zero. On the other hand, as shown in FIG. 2B, in the case of the sealing portion 2 not provided with the second glass portion 7, there is no portion in which a compressive strain is locally present, and the magnitude of the first glass portion 8 is substantially zero.

The inventors of the present invention actually measured the strain of the lamp 100 quantitatively, and observed that a compressive stress is present in the second glass portion 7. FIGS. 3 and 4 show the measurement results. This quantitation of the strain was performed using a sensitive color plate method utilizing photoelastic effect. According to this method, the color in the portion having a strain (stress) looks changed, and this color is compared to a strain standard so that the magnitude of the strain can be quantitated. In other words, a stress can be calculated by reading an optical path difference between the color with a strain to be determined and the standard color. A measuring device for quantitating a strain is a strain detector (SVP-200 manufactured by Toshiba Corporation), and when this strain detector is used, the magnitude of the compressive strain of the sealing portion 2 can be obtained as an average of the stress applied to the sealing portion 2.

Figure 3A:
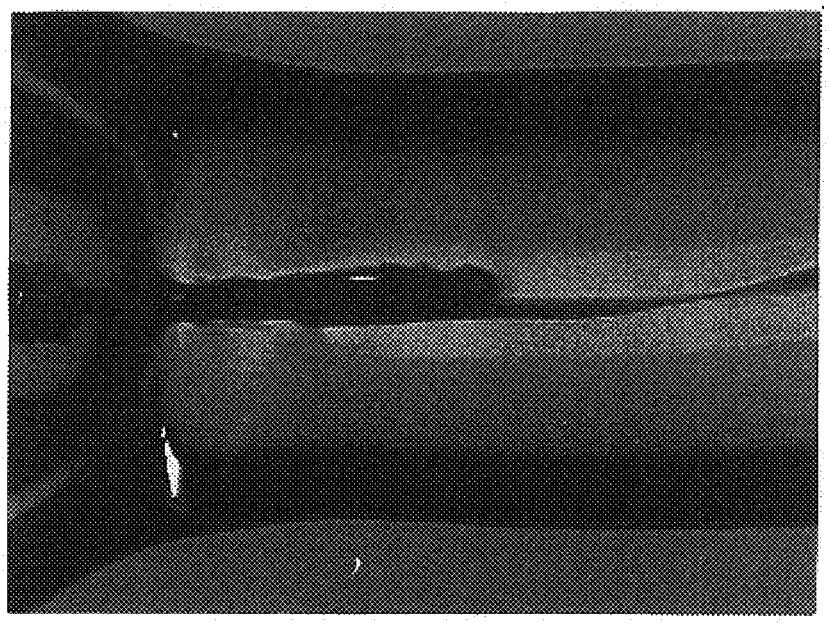
FIGS. 3A and 3B are photographs substituted for drawings showing the distribution of compressive strain of a lamp measured by a sensitive color plate method utilizing photoelastic effect.
Figure 3B:
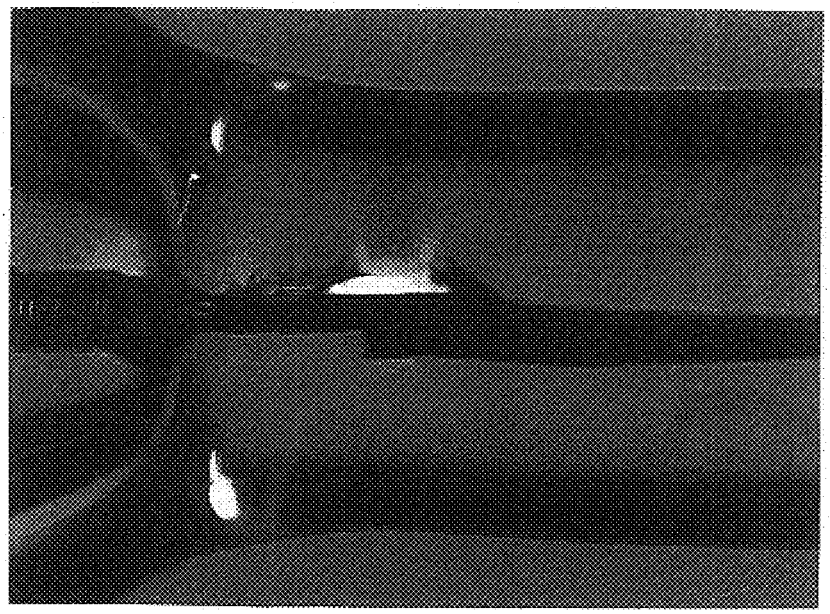
Figure 4A:
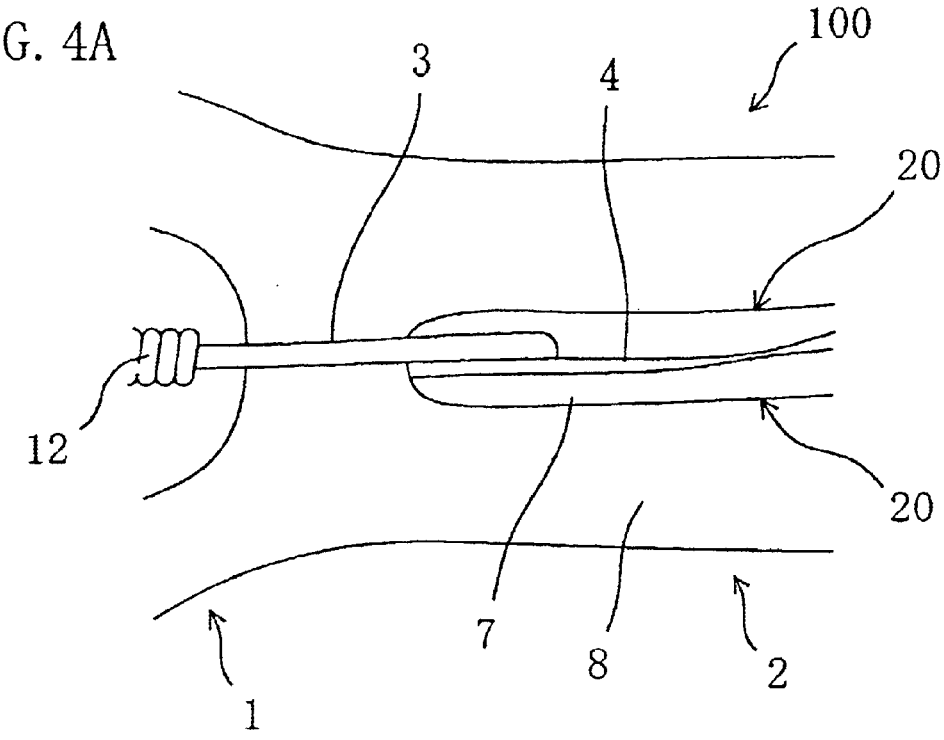
FIGS. 4A and 4B are traced drawings of FIGS. 3A and 3B, respectively.
Figure 4B:
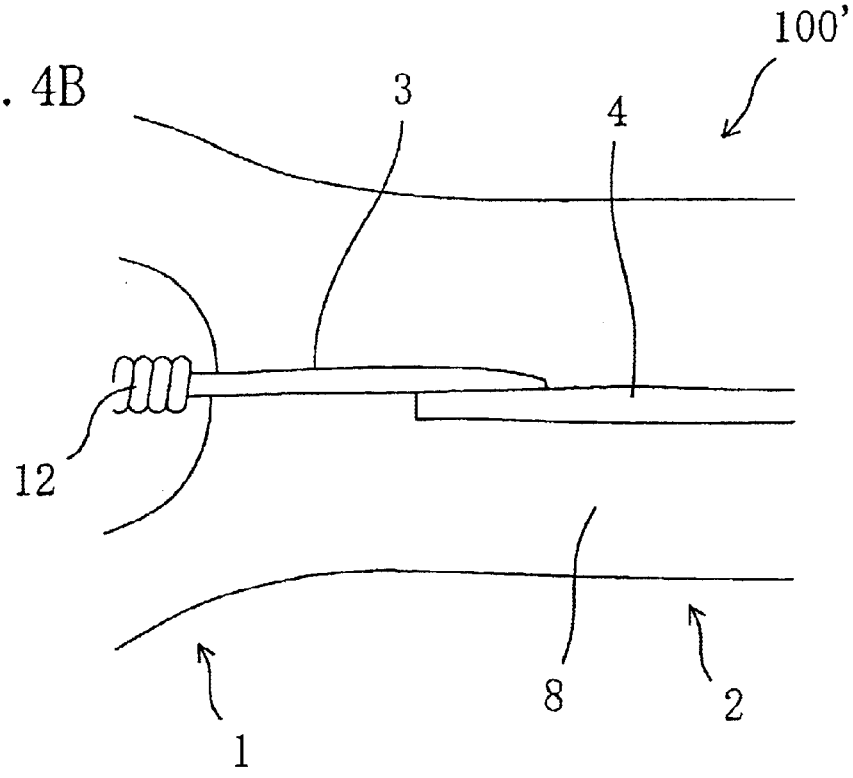

FIG. 3A is a photograph showing the distribution of the compressive stress of the lamp 100 measured by the sensitive color plate method utilizing photoelastic effect. FIG. 3B is a photograph showing the distribution of the compressive stress of the lamp 100' that is not provided with the second glass portion 7. FIGS. 4A and 4B are traced drawings of FIGS. 3A and 3B, respectively.

As shown in FIGS. 3A and 4A, there is a region in the second glass portion 7 that has a different color (pale color) from that in the surrounding region (8) in the sealing portion 2 of the lamp 100, which indicates that a compressive stress (compressive strain) is present in the second glass portion 7. On the other hand, as shown in FIGS. 3B and 4B, there is no region having a different color (pale color) in the sealing portion 2 of the lamp 100', which indicates that no compressive stress (compressive strain) is present in any specific regions.

Next, the principle of the strain measurement by the sensitive color plate method utilizing photoelastic effect will be described briefly with reference to FIG. 5. FIGS. 5A and 5B are schematic views showing the state in which linearly polarized light obtained by transmitting light through a polarizing plate is incident to glass. Herein, the vibration direction of the linearly polarized light is taken as u, u can be regarded as being obtained by synthesizing u1 and u2.

Figure 5A:
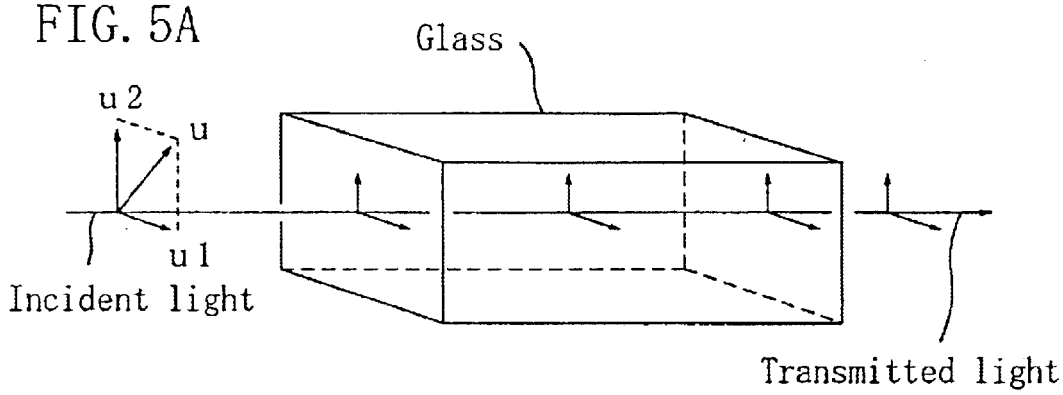
FIGS. 5A and 5B are drawings for explaining the principle of the measurement of strain by a sensitive color plate method utilizing photoelastic effect.
Figure 5B:
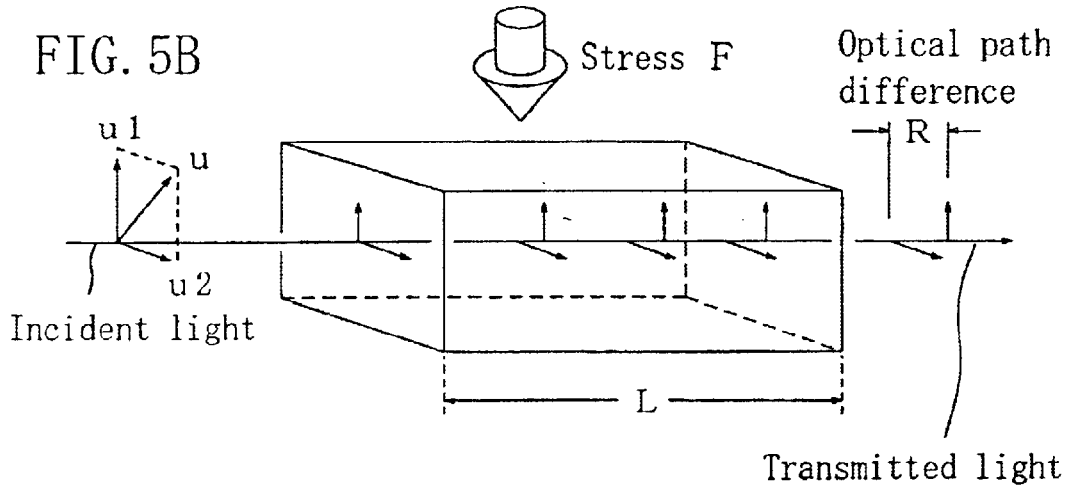

As shown in FIG. 5A, when there is no strain in the glass, u1 and u2 are transmitted through it at the same speed, so that no displacement of the transmitted lights u1 and u2 occurs. On the other hand, as shown in FIG. 5B, when there is a strain in the glass, and a stress F is applied thereto, u1 and u2 are not transmitted through it at the same speed, so that an offset of the transmitted lights u1 and u2 occurs. In other words, one of u1 and u2 is later than the other. The distance of this difference made by being late is referred to as an optical path difference. The optical path difference R can be expressed as $R=C\cdot F\cdot L$, because the stress F and the distance of transmission through the glass L are proportional, where F is a stress, L is a distance of transmission through the glass, and C is a proportional constant. The unit of each letter is as follows: R (nm); F (kgf/cm$^2$); L (cm); and C({nm/cm}/{kgf/cm$^2$}). C is referred to as "photoelastic constant" and depends on the material such as glass. As seen from the above equation, if C is known and L and R are measured, then F can be obtained.

The inventors of the present invention measured the distance L of light transmission in the sealing portion 2, that is, the outer diameter L of the sealing portion 2, and the optical path difference R was read from the color of the sealing portion 2 at the time of measurement with a strain standard. The photoelastic constant of quartz glass, which is 3.5, was used as the photoelastic constant C. These values were substituted in the above equation and the result of the calculated stress value was shown in the bar chart of FIG. 6.

Figure 6:
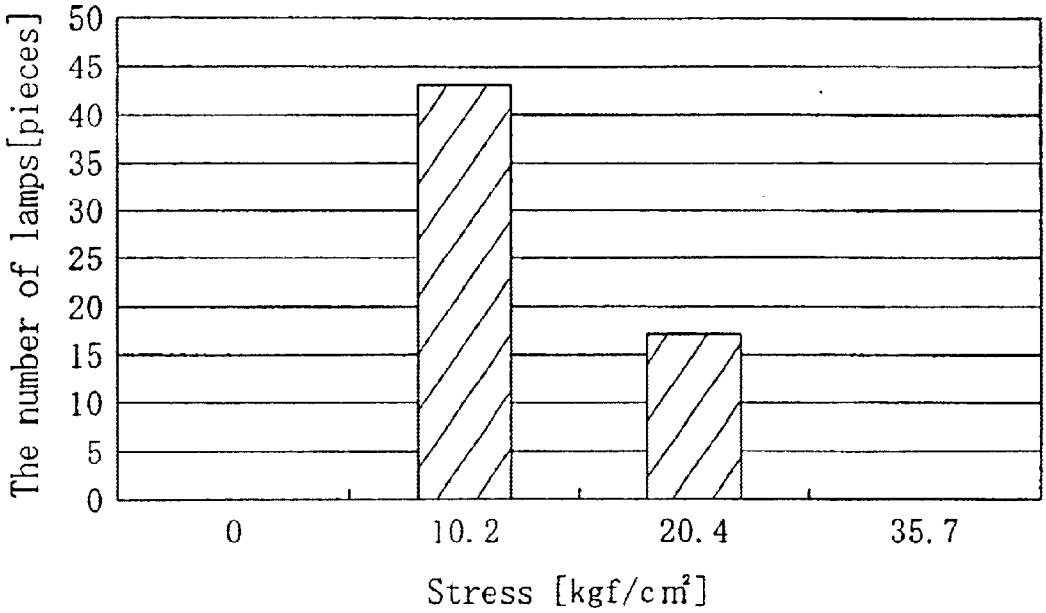
FIG. 6 is a graph showing a graph showing the relationship between a stress [kgf/cm$^2$] and the number of lamps.

As shown in FIG. 6, the number of lamps whose stress is 0 kgf/cm$^2$ was 0, the number of lamps whose stress is 10.2 kgf/cm$^2$ was 43, the number of lamps whose stress is 20.4 kgf/cm$^2$ was 17, and the number of lamps whose stress is 35.7 kgf/cm$^2$ was 0. On the other hand, in the case of the lamp 100' of a comparative example, the stress was 0 kgf/cm$^2$ for all the lamps that were measured. Following the principle of measurement, the compressive stress of the sealing portion 2 was calculated from the average value of the stress applied to the sealing portion 2, but it can be easily concluded from the results of FIGS. 3, 4 and 6 that providing the second glass portion 7 creates a state in which a compressive stress is applied to a portion of the sealing portion 2. This is because, the comparative lamp 100' had no compressive stress in the sealing portion 2. FIG. 6 shows discrete stress values. This is due to the fact that the optical path difference read with the strain standard is discrete. Therefore, the stress values are discrete because of the principle of the strain measurement with the sensitive color plate method. In reality, it seems that there are stress values between, for example, 10.2 kgf/cm$^2$ and 20.4 kgf/cm$^2$. Nevertheless, it is still true that a predetermined amount of compressive stress is present in the sealing portion 2 or the vicinity of the outer circumference of the second glass portion 7.

In this measurement, stress in the longitudinal direction (direction in which the electrode rod 3 is extending) of the sealing portion 2 was observed, but this does not mean that there is no compressive stress in other directions. It is necessary to cut the luminous bulb 1 or the sealing portion 2 in order to determine whether or not a compressive stress is present in the radial direction (the direction from the center to the outer circumference) or the circumferential direction (e.g., the clockwise direction), but as soon as such cutting is performed, the compressive stress in the second glass portion 7 is reduced. Therefore, only the compressive stress in the longitudinal direction can be measured without cutting the lamp 100. Consequently, the inventors of the present invention quantitated the compressive stress in this direction.

In the lamp 100 of this embodiment, a compressive strain (at least compressive strain in the longitudinal direction) is present in the second glass portion 7 provided at least in a portion inside the first glass portion 8, so that the strength against pressure of a high pressure discharge lamp can be improved. In other words, the lamp 100 of this embodiment shown in FIGS. 1 and 2A can have a higher strength against pressure than that of the comparative lamp 100' shown in FIG. 2B. It is possible to operate the lamp 100 of this embodiment shown in FIG. 1 at an operating pressure of 30 MPa or more, which is more than a highest level of the conventional lamps of about 20 MPa.

Figure 7A:
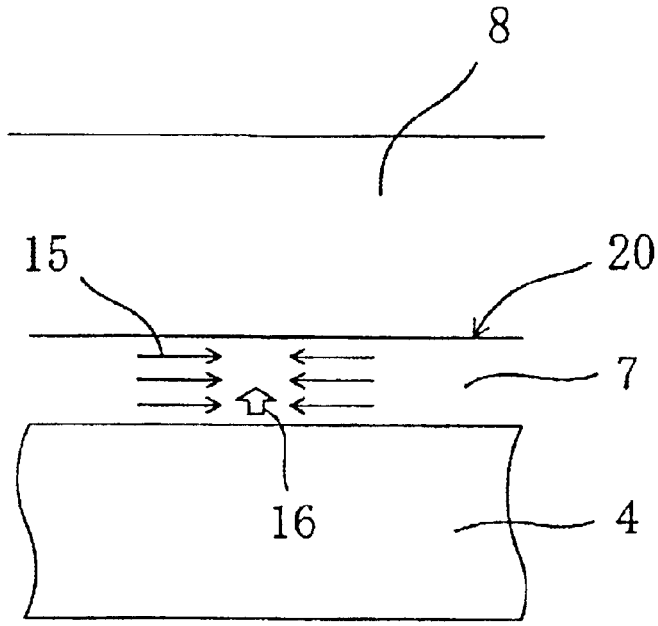
FIGS. 7A and 7B are enlarged views of the principal part for explaining the reason why the strength against pressure of the lamp 100 is increased by a compressive strain occurring in the second glass portion 7.
Figure 7B:
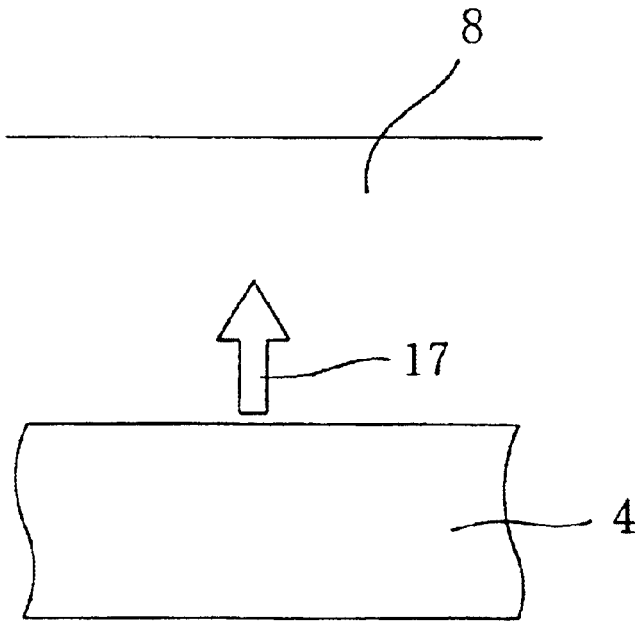

Next, the reason why the strength against pressure of the lamp 100 is increased by the compressive strain in the second glass portion 7 with reference to FIG. 7. FIG. 7A is an enlarged view of the principal part of the sealing portion 2 of the lamp 100, and FIG. 7B is an enlarged view of the principal part of the sealing portion 2 of the comparative lamp 100'.

There are still unclear aspects as to the mechanism that increases the strength against pressure of the lamp 100, but the inventors of the present invention inferred as follows.

First, the premise is that the metal foil 4 in the sealing portion 2 is heated and expanded during lamp operation, so that a stress from the metal foil 4 is applied to the glass portion of the sealing portion 2. More specifically, in addition to the fact that the thermal expansion coefficient of metal is larger than that of glass, the metal foil 4 that is thermally connected to the electrode rod 3 and through which current is transmitted is heated more readily than the glass portion of the sealing portion 2, so that stress is applied more readily from the metal foil 4 (in particular, from the side of the foil whose area is small) to the glass portion.

As shown in FIG. 7A, it seems that when a compressive stress is applied in the longitudinal direction of the second glass portion 7, a stress 16 is suppressed from occurring from the metal foil 4. In other words, it seems that the compressive stress 15 of the second glass portion 7 can suppresses the large stress 16 from occurring. As a results, for example, the possibility of generating cracks in the glass portion of the sealing portion 2 or causing leakage between the glass portion of the sealing portion 2 and the metal foil 4 is reduced, so that the strength of the sealing portion 2 can be improved.

On the other hand, as shown in FIG. 7B, in the case of the structure not provided with the second glass portion 7, it seems that a stress 17 from the metal foil 4 is larger than in the case of the structure shown in FIG. 7A. In other words, it seems that since there is no region to which a compressive stress is applied, the stress 17 from the metal foil 4 becomes larger than the stress 16 shown in FIG. 7A. Therefore, it is inferred that the structure shown in FIG. 7A can increase the strength against pressure more than the structure shown in FIG. 7B. This inference is compatible with a general nature of glass that when a tensile strain (tensile stress) is present in glass, then the glass is easily broken, and when a compressive strain (compressive stress) is present in glass, then the glass is hardly broken.

However, from the general nature of glass that when a compressive strain (compressive stress) is present in glass, then the glass is hardly broken, it cannot be inferred that the sealing portion 2 of the lamp 100 has a high strength against pressure. This is because of the following possible inference: Even if the strength of the glass in a region having a compressive strain is increased, a load is generated, compared to the case where there is no strain, when viewing the entire sealing portion 2, so that the strength of the sealing portion 2 as a whole is reduced on the contrary. It was not found that the strength, against pressure of the lamp 100 is improved, until the inventors of the present invention produced the lamp 100 and conducted experiments, and that could not be derived from a theory. If a compressive stress larger than necessary remains in the second glass portion 7 (or the vicinity of the outer circumference thereof), the sealing portion 2 may be damaged during lamp operation, and the life may be shortened on the contrary. In view of these, the structure of the lamp 100 having the second glass portion 7 exhibits a high strength against pressure under a superb balance. Inferring from the fact that the stress and strain of the second glass portion 7 is reduced when a portion of the luminous bulb 1 is cut, a load due to the stress and strain of the second glass portion 7 may be well received by the entire luminous bulb 1.

It is also inferred that the structure exhibiting a higher strength against pressure is brought about by a strain boundary region 20 generated by a difference in the compressive strain between the first glass portion 8 and the second glass portion 7. More specifically, the following inference is possible: There is substantially no compressive strain in the first glass portion 8, and a compressive strain is well confined into a region of only the second glass portion 7 (or the vicinity of the outer circumference) positioned near the center than the strain boundary region 20, which succeeds in providing excellent strength against pressure characteristics. As a result of the fact that stress values are shown discrete because of the principle of the strain measurement by the sensitive color plate method, the strain boundary region 20 is distinctly shown in FIG. 7A or other drawings, but even if actual stress values can be shown continuously, the stress values are believed to change drastically in the strain boundary region 20, and it seems that the strain boundary region 20 can be defined by the region that changes drastically.

Figure 8:
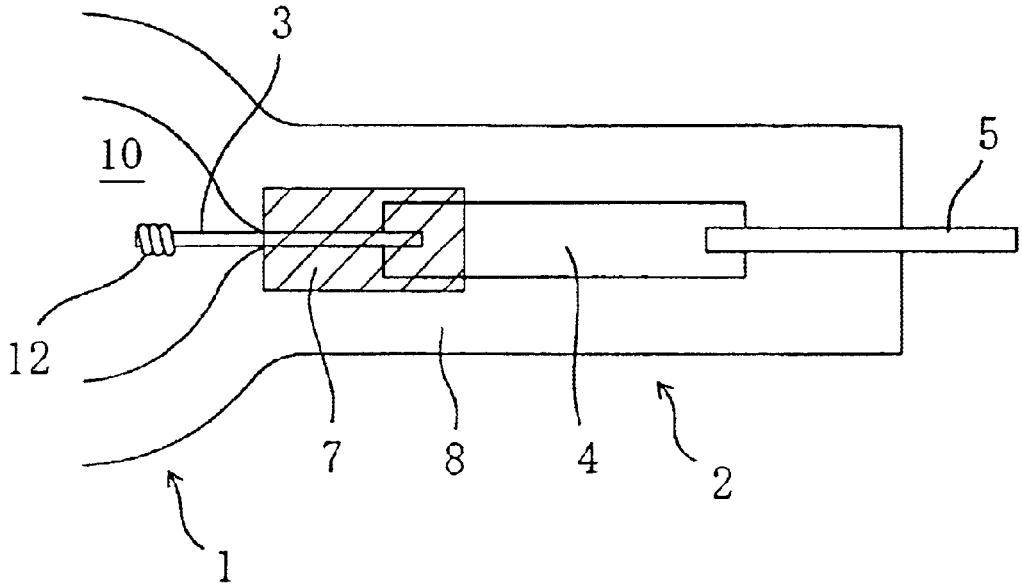
FIG. 8 is a schematic enlarged view of the principal part of a variation of the lamp 100.

In the lamp 100 of this embodiment, as shown in FIG. 1, the second glass portion 7 is disposed so as to cover the welded portion of the electrode rod 3 and the metal foil 4. The present invention is not limited to this structure, but the structure as shown in FIG. 8 can be used. More specifically, as shown in FIG. 8, the second glass portion 7 can be disposed so as to cover the entire portion of the electrode rod 3 that is buried in the sealing portion 2 and a portion of the metal foil 4. In this case, a portion of the second glass portion 7 can be exposed to the discharge space 10 in the luminous bulb 1. That is to say, even if H in the FIG. 1A is set to 0, and a portion of the second glass portion 7 is exposed to the discharge space 10 in the luminous bulb 1, there are no problems in terms of improvement of strength against pressure. However, in the case where the lamp 100 is a high pressure mercury lamp, a structure in which the second glass portion 7 is not exposed to the discharge space 10 is one possibility in view of the light color characteristics or the life. This is because since the second glass portion 7 contains $Al_2O_3$ and B as well as $SiO_2$, when these additives enter the discharge space 10, the characteristics of the lamp may deteriorate. As shown in FIGS. 1 and 8, the second glass portion 7 is disposed so as to cover the welded portion of the electrode rod 3 and the metal foil 4, because comparatively many damages and cracks occur in this welded portion, so that this is for increasing the strength in this portion.

Figure 9:
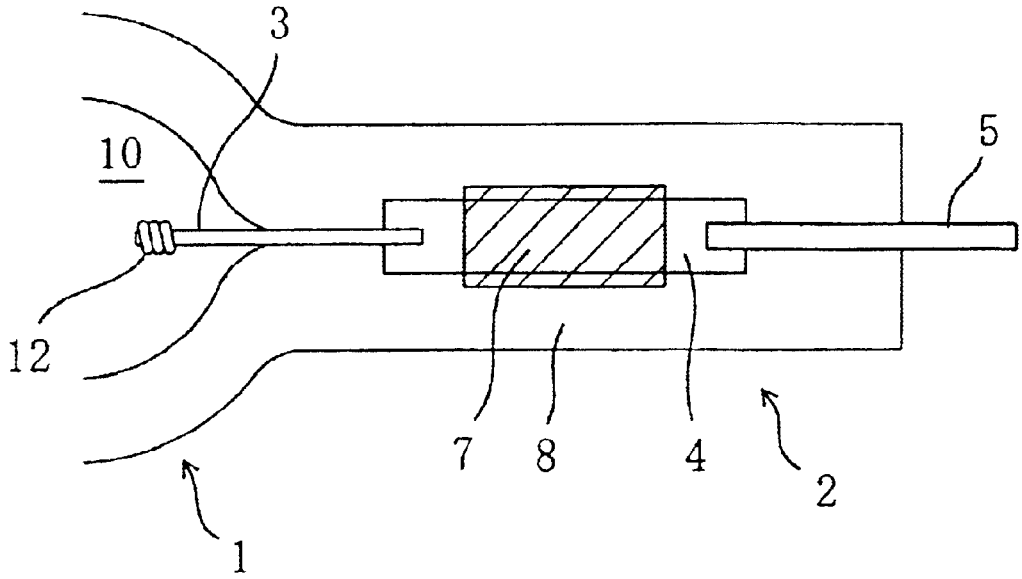
FIG. 9 is a schematic enlarged view of the principal part of a variation of the lamp 100.
Figure 10:
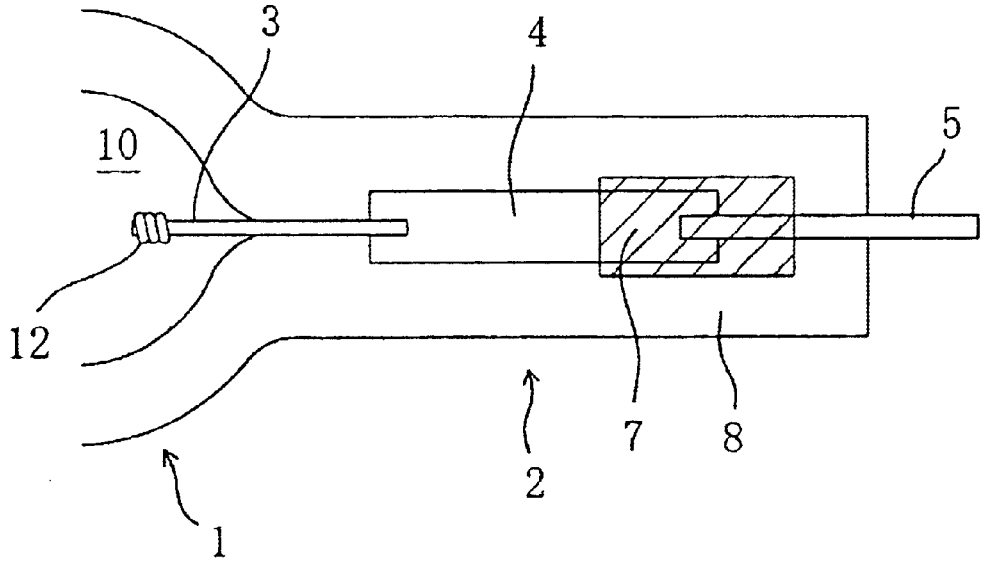
FIG. 10 is a schematic enlarged view of the principal part of a variation of the lamp 100.
Figure 11:
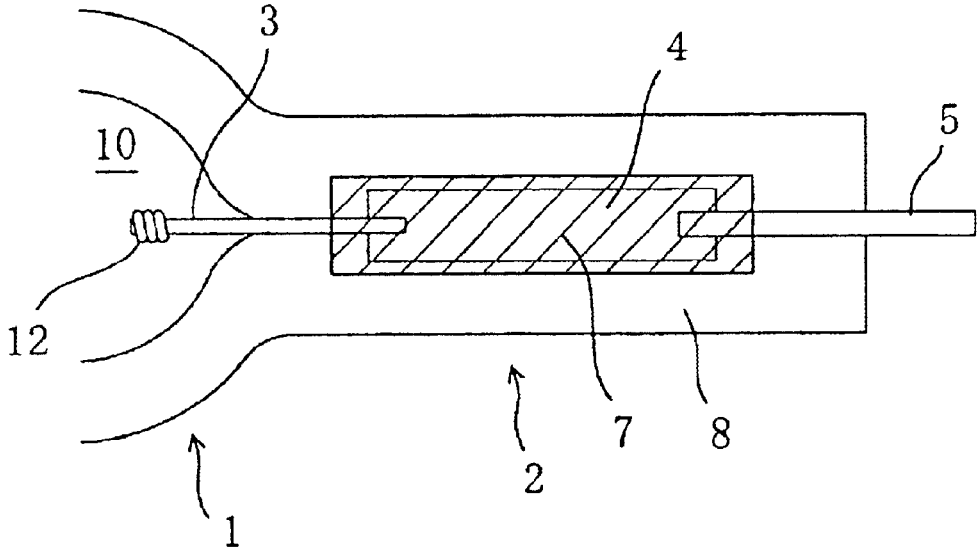
FIG. 11 is a schematic enlarged view of the principal part of a variation of the lamp 100.

Furthermore, structures as shown in FIGS. 9 to 11 can be used. More specifically, as shown in FIG. 9, the second glass portion 7 may be disposed so as to cover the central portion of the metal foil 4, or as shown in FIG. 10, the second glass portion 7 may be disposed so as to cover the welded portion of the metal foil 4 and the external lead 5. Alternatively, as shown in FIG. 11, the second glass portion 7 may be disposed so as to cover the metal foil 4 entirely.

Not only the structure shown in FIG. 1 but also the structures shown in FIGS. 8 to 11 can improve the strength against pressure of the lamp. In other words, a larger amount of mercury is enclosed and the lamp can be operated at a higher operating pressure than in the case of the comparative lamp 100'.

In the structure shown in FIG. 1, the second glass portion 7 is provided in each of the pair of sealing portions 2, but the present invention is not limited to this structure, and also when the second glass portion 7 is provided in only one of the sealing portions 2, the strength against pressure can be higher than that of the comparative lamp 100'. However, it is preferable that the second glass portion 7 is provided in both the sealing portions 2, and both the sealing portions 2 have a region to which a compressive stress is applied. This is because a higher strength against pressure can be achieved when both the sealing portions 2 have a region to which a compressive stress is applied than when only one of them has it. That is, the probability that leakage occurs in the sealing portion (i.e., the probability that a strength against pressure of a certain level cannot be maintained) can be ½ when there are two sealing portions having a portion to which a compressive stress is applied rather than when there is one sealing portion.

In this embodiment, a high pressure mercury lamp having a very large amount of mercury 6 enclosed (e.g., a superhigh pressure mercury lamp having an operating pressure of more than 20 MPa) has been described. However, the present invention can be applied preferably to a high pressure mercury lamp having a not very high mercury vapor pressure of about 1 MPa. This is because the fact that the lamp can be operated stably even if the operating pressure is very high means that the reliability of the lamp is high. That is to say, the structure of this embodiment is applied to a lamp having a not very high operating pressure (the operating pressure of the lamp is less than about 30 MPa, for example, about 20 MPa to about 1 MPa), the reliability of the lamp that operates at that operating pressure can be improved. The structure of this embodiment can be obtained simply by introducing the member of the second glass portion 7 as a new member, so that a small improvement can provide an effect of improving the strength against pressure. Therefore, this is very suitable for industrial applications.

Next, a method for producing the lamp 100 of this embodiment will be described with reference to FIGS. 12 to 19.

Figure 12:
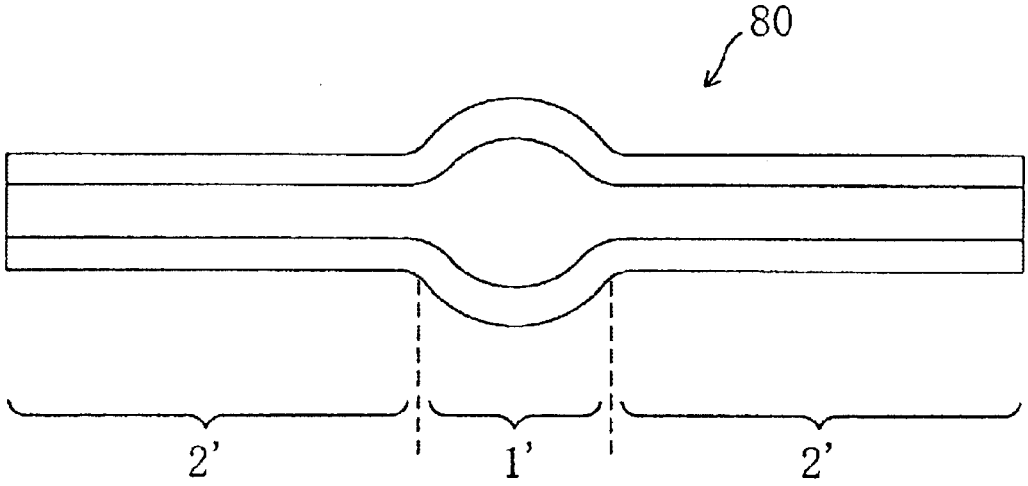
FIG. 12 is a schematic cross-sectional view showing the structure of a glass pipe 80 for a discharge lamp.

First, as shown in FIG. 12, a glass pipe 80 for a discharge lamp including a luminous bulb portion 1' that will be formed into the luminous bulb 1 of the lamp 100 and side tube portions 2' extending from the luminous bulb portion 1' is prepared. The glass pipe 80 of this embodiment is obtained by heating a predetermined position of a cylindrical quartz glass having an outer diameter of 6 mm and an inner diameter of 2 mm for expansion so as to form the substantially spherical luminous bulb portion 1'.

Figure 13:
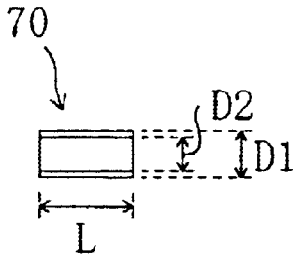
FIG. 13 is a schematic cross-sectional view showing the structure of a glass tube 70.

As shown in FIG. 13, a glass tube 70 that will be formed into the second glass portion 7 is prepared separately. The glass tube 70 of this embodiment is a Vycor glass tube having an outer diameter D1 of 1.9 mm, an inner diameter D2 of 1.7 mm and a length L of 7 mm. The outer diameter D1 of the glass tube 70 is smaller than the inner diameter of side tube portions 2' of the glass pipe 80 so that the glass tube 70 can be inserted into the side tube portions 2'.

Figure 14:
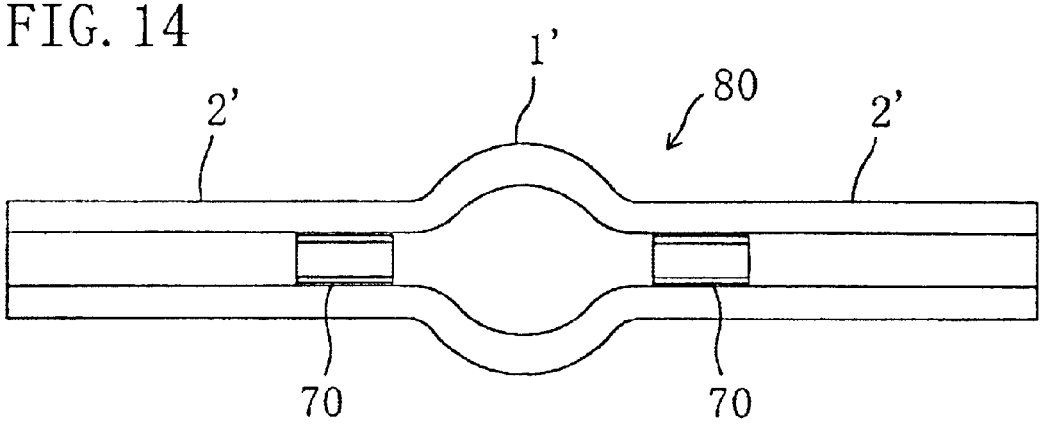
FIG. 14 is a cross-sectional view for explaining the process for fixing the glass tube 70 to a side tube portion 2' of the glass pipe 80.

Next, as shown in FIG. 14, the glass tubes 70 are fixed to the side tube portions 2' of the glass pipe 80. The fixation is performed by inserting the glass tubes 70 into the side tube portions 2' and heating the side tube portions 2' so that the two components 2' and 70 are attached. Hereinafter, this process will be described in greater detail.

First, one glass tube 70 is inserted into one side tube portion 2'. Then, the glass pipe 80 is attached to a lathe. Then, the position of the glass tube 70 is subjected to fine tuning with a tungsten rod that has been cleaned. This fine tuning work can be performed easily with a tungsten rod having a diameter that is smaller than the inner diameter of the side tube portion 2'. It is of course possible to use a rod other than the tungsten rod.

Finally, the side tube portion 2' is heated with a burner, so that the glass tube 70 is fixed to the side tube portion 2' by attaching the outer wall of the glass tube 70 to the inner wall of the side tube portion 2'. In this process, water content that is considered to affect adversely the lamp (more specifically, the water content of the Vycor constituting the glass tube 70) can be removed from the lamp, and consequently a high purity lamp can be achieved. The same process is performed with respect to the other side tube portion 2', so that the glass tube 70 is fixed to the side tube portion 2'. Thus, the structure as shown in FIG. 14 can be obtained. In this case, after the structure shown in FIG. 14 is produced, it is preferable to clean the inside of the tube. This is because in the process of inserting and fixing the glass tube 70, impurities might be mixed.

Figure 15:
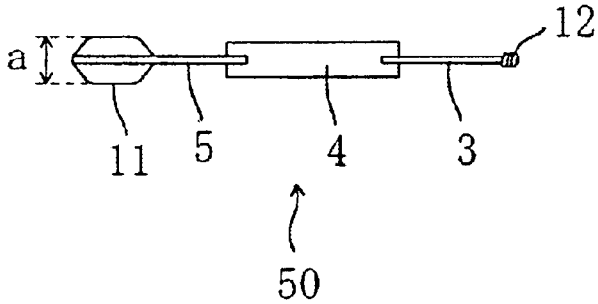
FIG. 15 is a schematic view showing the structure of an electrode structure 50.

Then, a separately produced electrode structure 50 as shown in FIG. 15 is prepared and inserted into the side tube portion 2' to which the glass tube 70 is fixed. The electrode structure 50 includes an electrode rod 3, a metal foil 4 connected to the electrode rod 3 and an external lead 5 connected to the metal foil 4. The electrode rod 3 is a tungsten electrode rod, and a tungsten coil 12 is wound around the head thereof. The coil 12 can be a coil made of thorium—tungsten. The electrode rod 3 is not necessarily a tungsten rod, but can be a rod made of thorium—tungsten. A supporting member (metal hook) 11 for fixing the electrode structure 50 onto the inner surface of the side tube portion 2' is provided in one end of the external lead 5. The supporting member 11 shown in FIG. 15 is a molybdenum tape (Mo tape) made of molybdenum, but this can be replaced by a ring-shaped spring made of molybdenum. The width a of the Mo tape 11 is slightly larger than the inner diameter of the side tube portion 2', which is 2 mm, and thus the electrode structure 50 can be fixed inside the side tube portion 2'.

Figure 16:
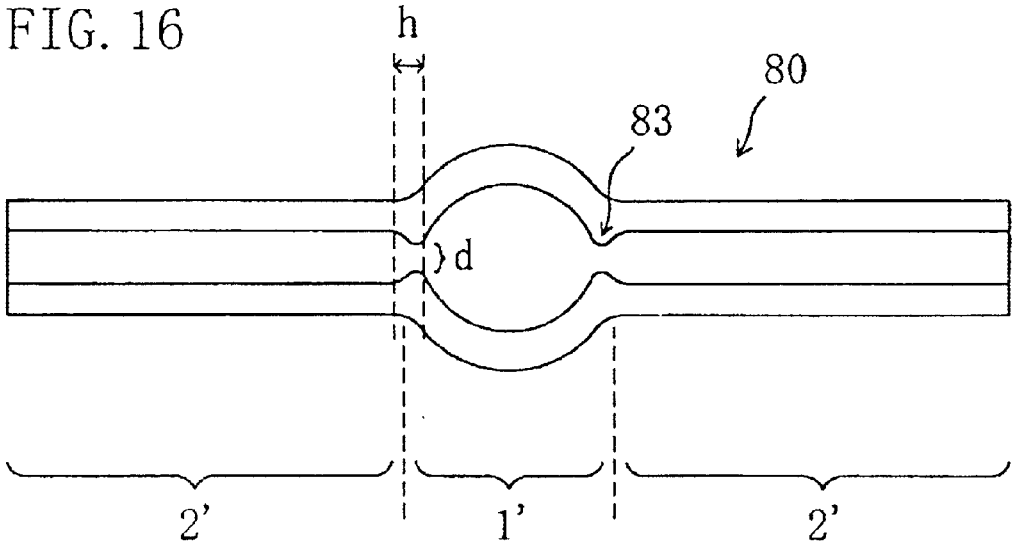
FIG. 16 is a schematic cross-sectional view showing the structure of the glass pipe 80 provided with a portion 83 having a small diameter.

In this embodiment, the glass pipe 80 for a discharge lamp as shown in FIG. 12 is used, but instead a glass pipe 80 as shown in FIG. 16 can be used. In the glass pipe 80 shown in FIG. 16, a portion 83 having a small diameter (hereinafter, referred to a "small diameter portion") in which the inner diameter of the side tube portion 2' is smaller than that of other portions is provided in the vicinity of the boundary of the side tube portions 2' and the luminous bulb portion 1'. This small diameter portion 83 is also called "reeding". The inner diameter d of the small diameter portion 83 has a size that allows the glass tube 70 to stay there, and the size is, for example, about 1.8 mm. The size of a region h (size in the longitudinal direction of the side tube portion 2') in which the small diameter portion 83 is formed is, for example, about 1 to 2 mm. The small diameter portion 83 can be formed by irradiating a predetermined portion (region h) of the glass pipe 80 shown in FIG. 12 with a laser to heat the predetermined portion. In this embodiment, the small diameter portion 83 is formed under a reduced pressure (e.g., the pressure of Ar is $10^{-3}$ Pa) in the pipe 80. However, if the portion of the region h can be shrunk, the small diameter portion 83 can be formed in an atmospheric pressure. Providing the small diameter portion 83 in the glass pipe 80 makes the process for inserting glass tube 70 easy. That is to say, the glass tube 70 can be fixed to a predetermined position easily.

Figure 17:
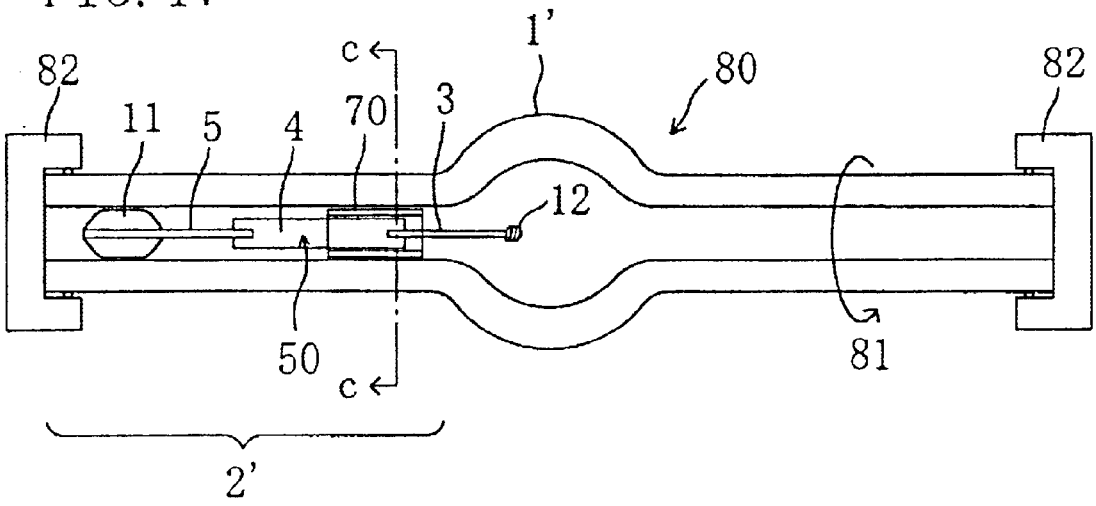
FIG. 17 is a cross-sectional view for explaining the process for inserting the electrode structure 50.
Figure 18:
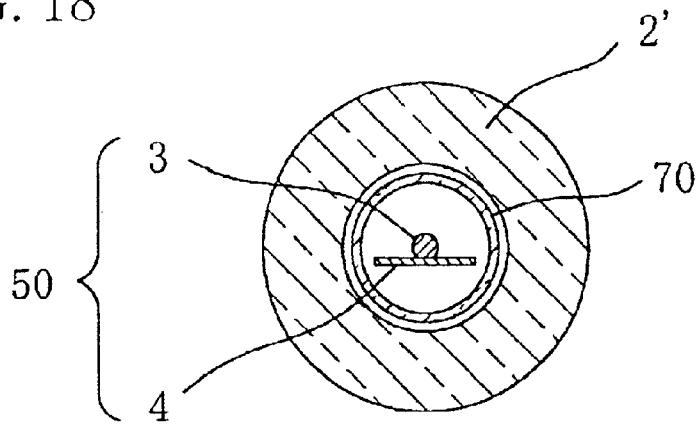
FIG. 18 is a cross-sectional view taken along line c—c in FIG. 17.

The electrode structure 50 can be inserted into the side tube portion 2' in the following manner. As shown in FIG. 17, the electrode structure 50 is passed through one side tube portion 2', and the head 12 of the electrode rod 3 is positioned in the luminous bulb portion 1'. In this case, the Mo tape 11 is in contact with the inner wall of the side tube portion 2', so that a slight resistance is applied when the electrode structure 50 is passed through. Therefore, the electrode structure 50 is pushed up to the predetermined position with a sufficiently cleaned tungsten rod. After the electrode structure 50 is pushed up to the predetermined position, the electrode structure 50 is fixed at that position with the Mo tape 11. FIG. 18 shows the cross-sectional structure taken along line c—c of FIG. 17.

Then, both ends of the glass pipe 80 with the electrode structure 50 inserted therein are attached to a rotatable chuck 82 while the airtightness is maintained. The chuck 82 is connected to a vacuum system (not shown) and can reduce the pressure inside the glass pipe 80. After the glass pipe 80 is evacuated to a vacuum, a rare gas (Ar) with about 200 torr (about 20 kPa) is introduced. Thereafter, the glass pipe 80 is rotated around the electrode rod 3 as the central axis for rotation in the direction shown by arrow 81.

Figure 19:
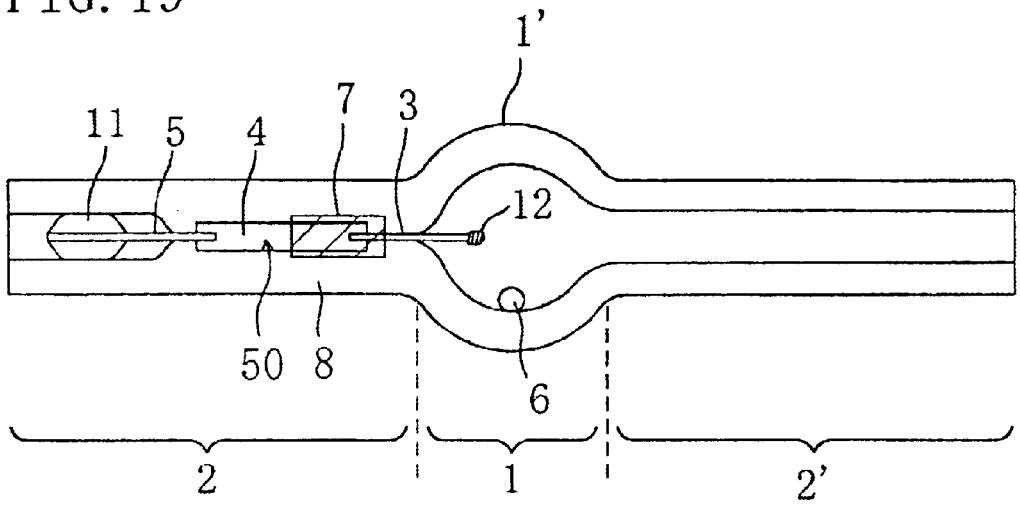
FIG. 19 is a cross-sectional view for explaining the process for forming a sealing portion.

Then, the side tube portion 2' and the glass tube 70 are heated and shrunk so that the electrode structure 50 is sealed, and thus, as shown in FIG. 19, the sealing portion 2 provided with the second glass portion 7, which was the glass tube 70, is formed inside the first glass portion 8, which was the side tube portion 2'. The sealing portion 2 can be formed by heating the side tube portion 2' and glass tube 70 sequentially from the boundary portion between the luminous bulb portion 1' and the side tube portion 2' to the vicinity of the middle portion of the external lead 5 for shrinking. This sealing portion formation process provides the sealing portion 2 including a portion in which a compressive stress is applied at least in the longitudinal direction (axis direction of the electrode rod 3) from the side tube portion 2' and the glass tube 70. Heating for shrinking can be performed in the direction from the external lead 5 to the luminous bulb portion 1'. Thereafter, a predetermined amount of mercury 6 is introduced from the end portion on the side of the side tube portion 2' that is open. In this case, halogen (e.g., $CH_2Br_2$) can be introduced, if necessary.

After the mercury 6 is introduced, the same process is performed with respect to the other side tube portion 2'. More specifically, the electrode structure 50 is inserted into the side tube portion 2' that has not been sealed yet, and then the glass pipe 80 is evacuated to a vacuum (preferably to about $10^{-4}$ Pa), a rare gas is enclosed and heating is performed for sealing. It is preferable to perform heating for sealing while cooling the luminous bulb portion 1 in order to prevent mercury from evaporating. When both the side tube portions 2' are sealed in this manner, the lamp 100 shown in FIG. 1 is completed.

Next, the mechanism that applies a compressive stress to the second glass portion 7 (or the vicinity of the circumference thereof) by the sealing portion formation process will be described with reference to FIGS. 20A and 20B. This mechanism is inferred by the inventors of the present invention, and therefore the true mechanism may not be like this. However, for example, as shown in FIG. 3A, it is the fact that a compressive stress (compressive strain) is present in the second glass portion 7 (or the vicinity of the circumference thereof), and also it is the fact that the strength against pressure is improved by the sealing portion 2 including a portion to which the compressive stress is applied.

Figure 20A:
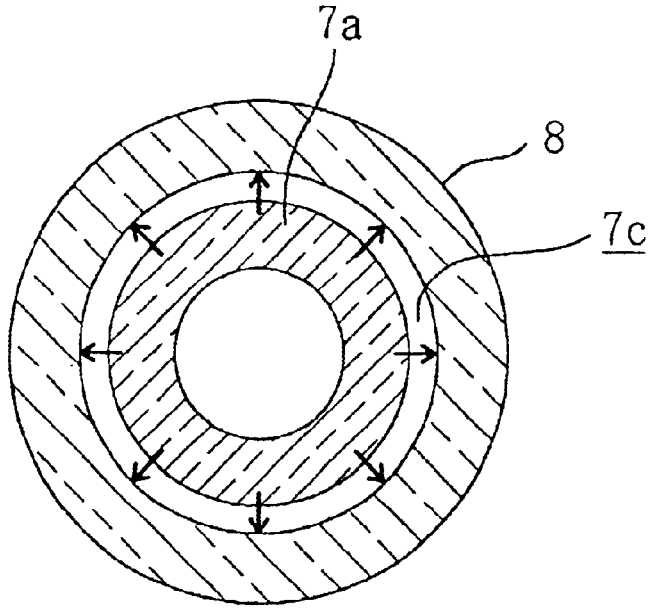
FIGS. 20A and 20B are cross-sectional views for explaining the mechanism that creates a compressive strain in the second glass portion 7.
Figure 20B:
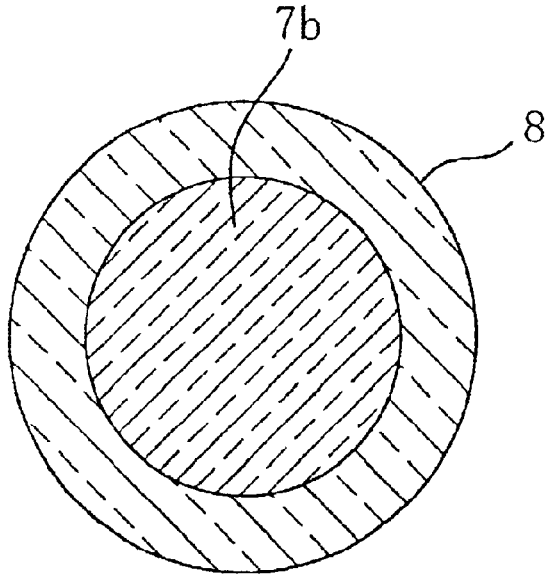

FIG. 20A is a schematic view showing the cross sectional structure at the time when the second glass portion 7*a* that is in the state of the glass tube 70 is inserted into the first glass portion 8 that is in the state of the side tube portion 2'. On the other hand, FIG. 20B is a schematic view showing the cross sectional structure at the time when the second glass portion 7*a* is softened and is in a molten state 7*b* in the structure of FIG. 20A. In this embodiment, the first glass portion 8 is made of quartz glass containing 99 wt % or more of $SiO_2$, and the second glass portion 7*a* is made of Vycor glass.

First, it is assumed that when a compressive stress (compressive strain) is present, there is a difference in the thermal expansion coefficient between materials that are in contact with each other in many cases. In other words, the reason why a compressive stress is applied to the second glass portion 7 that is provided in the sealing portion 2 is that in general there is a difference in the thermal expansion coefficient between the two components. However, in this case, in reality, there is no large difference in the thermal expansion coefficient between the two components, and they are substantially equal. More specifically, the thermal expansion coefficients of tungsten and molybdenum, which are metals, are about $46\times10^{-7}$/° C. and about 37 to $53\times10^{-7}$/° C., respectively. The thermal expansion coefficient of quartz glass constituting the first glass portion 8 is about $5.5\times10^{-7}$/° C., and the thermal expansion coefficient of Vycor glass is about $7\times10^{-7}$/° C., which is the same level as that of quartz glass. It does not seem possible that such a small difference in the thermal expansion coefficient causes a compressive stress of about 10 kgf /cm$^2$ or more. The difference between the two components lies in the softening point or the strain point rather than the thermal expansion coefficient, and when this aspect is focused on, the following mechanism may explain why a compressive stress is applied. The softening portion and the strain point of quartz glass are 1650° C. and 1070° C., respectively (annealing point is 1150° C.). The softening portion and the strain point of Vycor glass are 1530° C. and 890° C., respectively (annealing point is 1020° C.).

When the first glass portion 8 (side tube portion 2') that is in the state shown in FIG. 20A is heated from the outside for shrinking, at first, a gap 7*c* present between the two components is filled and the two components are in contact with each other. After shrinking, as shown in FIG. 20B, there is a point of time when the first glass portion 8 having a higher softening point and a larger area that is in contact with the air is relieved from the softened state (that is the point of time when it is solidified), and the second glass portion 7*b* that is positioned in an inner portion than that and has a lower softening point is still softened (in the molten state). The second glass portion 7*b* in this case has more flowability than the first glass portion 8, so that even if the thermal expansion coefficients of the two components are substantially the same in the regular state (at the time when they are not softened), it can be considered that the properties (e.g., elastic modulus, viscosity, density or the like) of the two components at this point are significantly different. Then, time passes further, and the second glass portion 7*b* that had flowability is cooled. Thus, when the temperature of the second glass portion 7*b* becomes lower than the softening point, the second glass portion 7 is also solidified as the first glass portion 8. If the softening point is the same between the first glass portion 8 and the second glass portion 7, the two glass portions may be cooled gradually from the outside and solidified without letting a compressive strain remain. However, in the structure of this embodiment, the first glass portion 8 is solidified earlier and then in some time later, the second glass portion 7 that is in an inner position is solidified, so that a compressive stress remains in the second glass portion 7 that is in the inner position. Considering these points, it can be said that the state of the second glass portion 7 is obtained as a result of performing a kind of indirect pinching.

If such a compressive stress remains, in general, the difference in the thermal expansion coefficient between the two components 7 and 8 will terminate the attachment state of the two components at a certain temperature. However, in this embodiment, since the thermal expansion coefficients of the two components are substantially equal, it can be inferred that the attachment state of the two components 7 and 8 can be maintained even if a compressive strain is present.

Furthermore, it was found that in order to apply a compressive stress of about 10 kgf/cm$^2$ to the second glass portion 7, it is necessary to heat the lamp completed by the above-described production method (a completed lamp) at 1030° C. for two hours or more. More specifically, the completed lamp 100 can be placed in a furnace with 1030° C. and annealed (i.e., baked in a vacuum or baked in a reduced pressure). The temperature of 1030° C. is only an example and any temperature that is higher than the strain point temperature of the second glass portion (Vycor glass) 7 can be used. That is to say, it can be higher than the strain point temperature of Vycor of 890° C. A preferable range of temperatures is that larger than the strain point temperature of Vycor of 890° C. and lower than the strain point temperature of the first glass portion (quartz glass) (strain point temperature of $SiO_2$ is 1070° C.), but some effect were seen at about 1080° C. or 1200° C. in the experiments conducted by the inventors of the present invention in some cases.

For comparison, when a high pressure discharge lamp that had not been annealed was measured by the sensitive color plate method, a compressive stress of about 10 kgf/cm$^2$ or more was not observed, although the second glass portion 7 was provided in the sealing portion 2 of the high pressure discharge lamp.

There is no limitation regarding the upper limit of annealing (or vacuum baking), as long as it is at least two hours, except for the upper limit that might be useful in view of economy. Any preferable time can be set as appropriate in the range of two hours or more. If some effect can be seen with a heat treatment for less than two hours, a heat treatment (annealing) can be performed for less than two hours. This annealing process may achieve high purity of the lamp, in other words, reduction of the impurities. This is because it seems that annealing the completed lamp can remove the water content that is considered to affect adversely the lamp (e.g., the water content of Vycor). If annealing is performed for 100 hours or more, the water content of the Vycor can be removed substantially completely from the lamp.

In the above description, an example in which the second glass portion 7 is formed of Vycor glass has been described. However, even if the second glass portion 7 is formed of glass containing 62 wt % of $SiO_2$, 13.8 wt % of $Al_2O_3$, 23.7 wt % of CuO as components (product name: SCY2 manufactured by SEMCOM Corporation: Strain point of 520° C.), the state in which a compressive stress is applied at least in the longitudinal direction is found to be achieved.

Next, another method for producing the lamp 100 of this embodiment will be described with reference to FIGS. 21 to 25.

Figure 21:
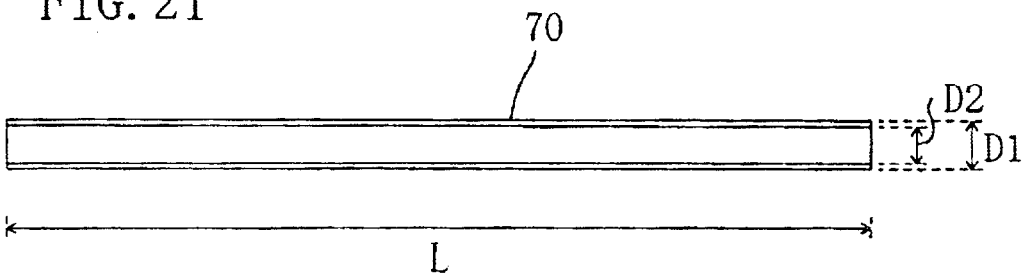
FIG. 21 is a schematic cross-sectional view showing the structure of the glass tube 70.
Figure 22:
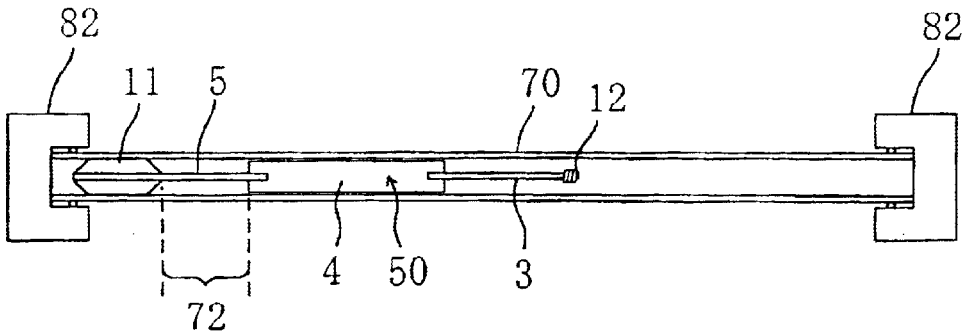
FIG. 22 is a cross-sectional view for explaining the process for inserting the electrode structure 50 into the glass tube 70.

First, as shown in FIG. 21, a glass tube 70 that will be formed into the second glass portion 7 is prepared. The glass tube 70 shown in FIG. 21 is a Vycor glass tube and the sizes thereof are as follows: the outer diameter D1 is 1.9 mm; the inner diameter D2 is 1.7 mm; and the length L is 100 mm. As shown in FIG. 22, the electrode structure 50 including the electrode rod 3 is inserted into the glass tube 70, and then both ends of the glass tube 70 are attached to a rotatable chuck 82 while the airtightness is maintained. The structure of the electrode structure 50 is the same as that described with reference to FIG. 15. The chuck 82 is connected to a vacuum system (not shown) and can evacuate the glass tube 70 to a vacuum.

Figure 23:
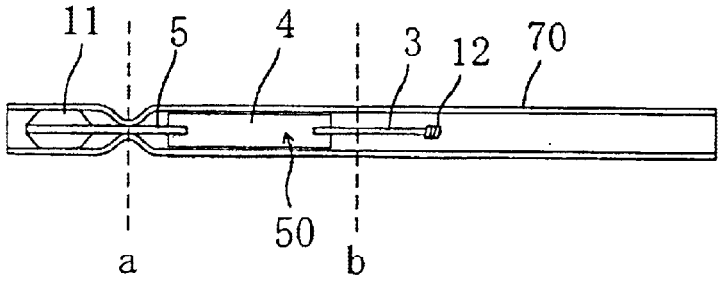
FIG. 23 is a cross-sectional view for explaining the process for shrinking the glass tube 70.
Figure 24:
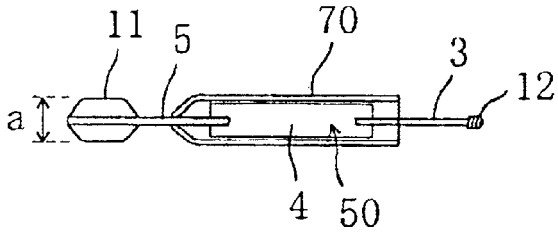
FIG. 24 is a schematic cross-sectional view showing the structure of the electrode structure 50 with the glass tube 70.

After the glass tube 70 is evacuated to a vacuum, a rare gas (Ar) with a reduced pressure (about 20 kPa) is enclosed. Then, the glass tube 70 is rotated around the electrode rod 3 as the axis, and then a portion 72 corresponding to the external lead 5 of the glass tube 70 is heated for shrinking, and thus the structure shown in FIG. 23 can be obtained. The glass tube 70 shown in FIG. 23 is cut at lines a and b in FIG. 23 and is processed so as to have the form shown in FIG. 24. The portion to be shrunk is not necessarily a portion of the external lead 5, but can be a portion of the electrode rod 3 or a portion of the metal foil 4.

Figure 25:
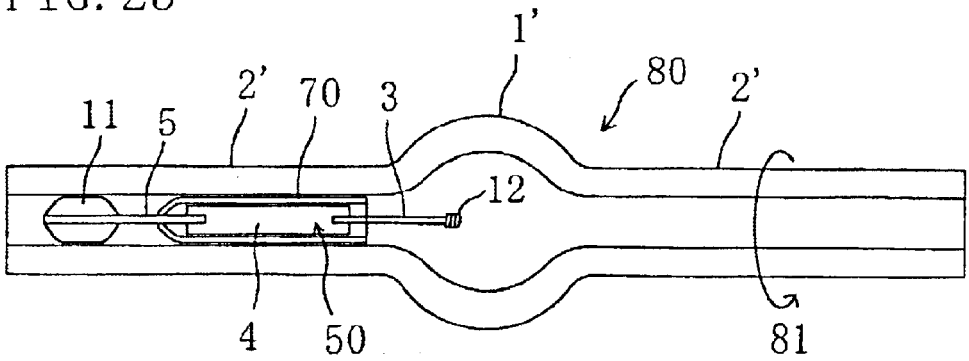
FIG. 25 is a schematic cross-sectional view for explaining the process for inserting the electrode structure 50 with the glass tube 70 into the side portion 2' of the glass pipe 80.

Next, as shown in FIG. 25, the electrode structure 50 provided with the glass tube 70 is inserted into one of the side tube portion 2' of the glass pipe 80. More specifically, the electrode structure 50 is pushed up to a predetermined position with a sufficiently cleaned tungsten rod and fixed thereto. When as a hook 11 of the electrode structure 50, a member having a width slightly larger than 2 mm is used, the electrode structure 50 can be fixed to a predetermined position easily.

Then, both ends of the glass pipe 80 are attached to a rotatable chuck (not shown) while the airtightness is maintained. Thereafter, in the same manner as in the method for producing the above-described embodiment (see FIGS. 17 and 19), the pipe 80 is evacuated to a vacuum, and a rare gas is introduced. Then, the glass pipe 80 is rotated around the electrode rod 3 as the central axis for rotation in the direction shown by arrow 81, and then is heated sequentially from the boundary portion between the luminous bulb portion 1' and the side tube portion 2' to the vicinity of the middle portion of the external lead 5 for shrinking. Thus, the electrode structure 50 provided with the glass tube 70 is sealed. Thereafter, a predetermined amount of mercury (e.g., about 200 mg/cc or 300 mg/cc or more) is introduced from the side of the side tube portion that is open. After the mercury is introduced, in the same manner as above, the electrode structure 50 provided with the glass tube 70 is inserted into the other side tube portion 2'. Then, the glass pipe 80 is evacuated to a vacuum, a rare gas is enclosed and heating is performed for sealing. As described above, it is preferable to perform heating for sealing while cooling the luminous bulb portion 1 in order to prevent mercury from evaporating. Thus, the lamp 100 shown in FIG. 11 can be obtained. In this embodiment as well, if heating is performed for two hours or more at 1030° C. after both the side tube portions 2' are sealed, the compressive strain can be increased.

Figure 26:
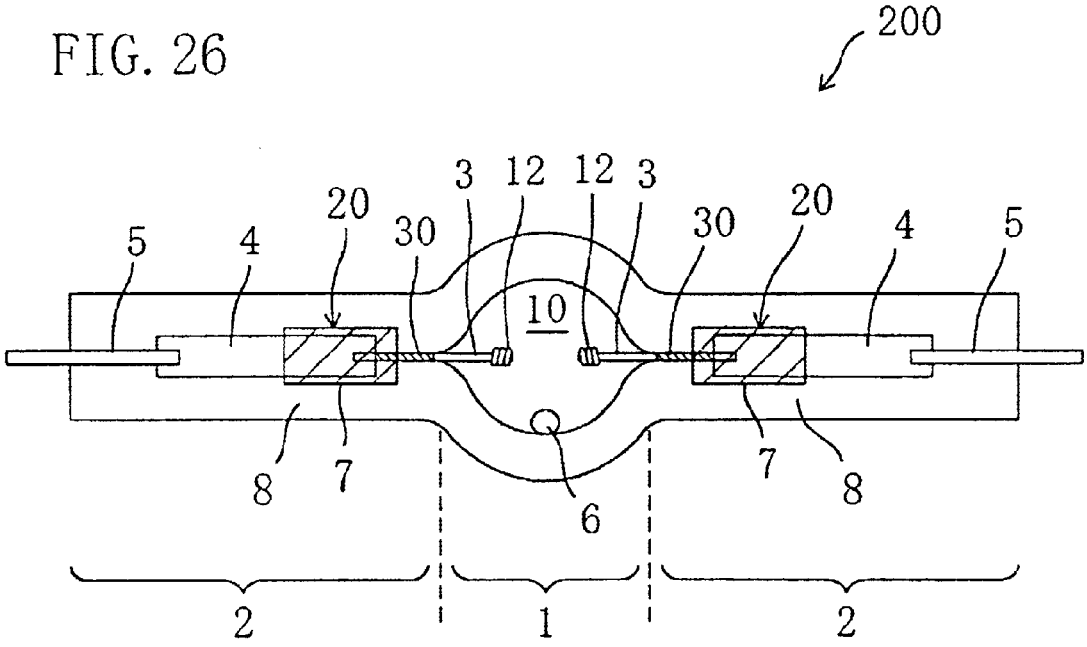
FIG. 26 is a schematic cross-sectional view showing the structure of a high pressure discharge lamp 200 of en embodiment of the present invention.

In order to further improve the strength against pressure of the lamp 100 of this embodiment, it is preferable to form a metal film (e.g., a Pt film) 30 on a surface of at least a portion of the electrode rod 3 that is buried in the sealing portion 2, as shown in the lamp 200 shown in FIG. 26. It is sufficient that the metal film 30 is formed of at least one metal selected from the group consisting of Pt, Ir, Rh, Ru, and Re, and it is preferable in view of attachment that the lower layer is an Au layer and the upper layer is, for example, a Pt layer.

In the lamp 200, the metal film 30 is formed on the surface of the portion of the electrode rod 3 that is buried in the sealing portion 2, and therefore small cracks are prevented from being generated in the glass positioned around the electrode rod 3. That is to say, in the lamp 200, in addition to the effects obtained by the lamp 100, the effect of preventing cracks can be obtained, and thus the strength against pressure can be improved further. The effect of preventing cracks will be described further below.

In the case of a lamp without the metal film 30 in the electrode rod 3 positioned in the sealing portion 2, in the process of forming the sealing portion in a lamp production process, the glass of the sealing portion 2 and the electrode rod 3 are attached once, and then during cooling, the two components are detached because of a difference in the thermal expansion coefficient between the two components. In this case, cracks are generated in the quartz glass around the electrode rod 3. This presence of cracks makes the strength against pressure lower than that of an ideal lamp without cracks.

In the case of the lamp 200 shown in FIG. 26, the metal film 30 having a Pt layer on its surface is formed on the surface of the electrode rod 3, so that the wettability between the quartz glass of the sealing portion 2 and the surface (Pt layer) of the electrode rod 3 becomes poor. In other words, the wettability of a combination of platinum and quartz glass is poorer than that of a combination of tungsten and quartz glass, so that the two components are not attached and easily detached. As a result, the poor wettability between the electrode rod 3 and the quartz glass makes it easy that two components are detached during cooling, which prevents small cracks from being generated. The lamp 200 produced based on the technical idea that cracks are prevented from being generated utilizing poor wettability as described above exhibits higher strength against pressure than that of the lamp 100.

Figure 27:
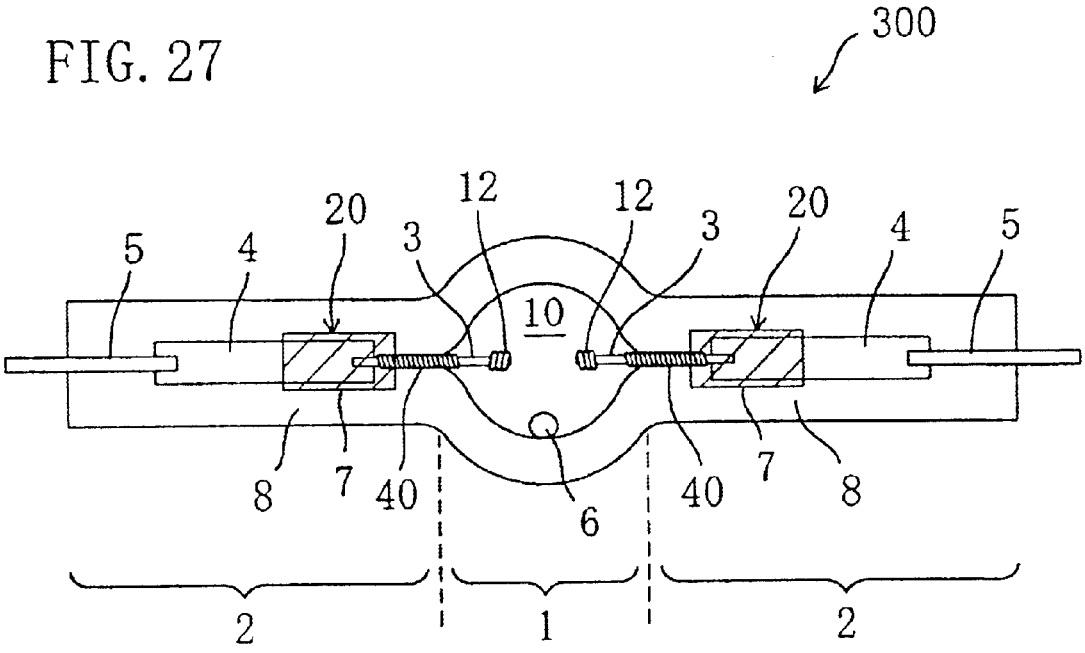
FIG. 27 is a schematic cross-sectional view showing the structure of a high pressure discharge lamp 300 of en embodiment of the present invention.

The structure of the lamp 200 shown in FIG. 26 can be replaced by the structure of a lamp 300 shown in FIG. 27. In the lamp 300, a coil 40 whose surface is coated with the metal film 30 is wound around the surface of the portion of the electrode rod 3 that is buried in the sealing portion 2 in the structure of the lamp 100 shown in FIG. 1. In other words, the lamp 300 has a structure in which the coil 40 having at least one metal selected from the group consisting of Pt, Ir, Rh, Ru, and Re at least on its surface is wound around the base of the electrode rod 3. In the structure shown in FIG. 27, the coil 40 is wound up to the portion of the electrode rod 3 that is positioned in the discharge space 10 of the luminous bulb 1. Also in the structure of the lamp 300 shown in FIG. 27, the wettability between the electrode rod 3 and the quartz glass can be made poor by the metal film 30 in the surface of the coil 40, so that small cracks can be prevented from being generated. The metal on the surface of the coil 40 can be formed by, for example, by plating. It is preferable in view of attachment that an Au layer for the lower layer is first formed on the coil 40 and then, for example, a Pt layer for the upper layer is formed.

Figure 28:
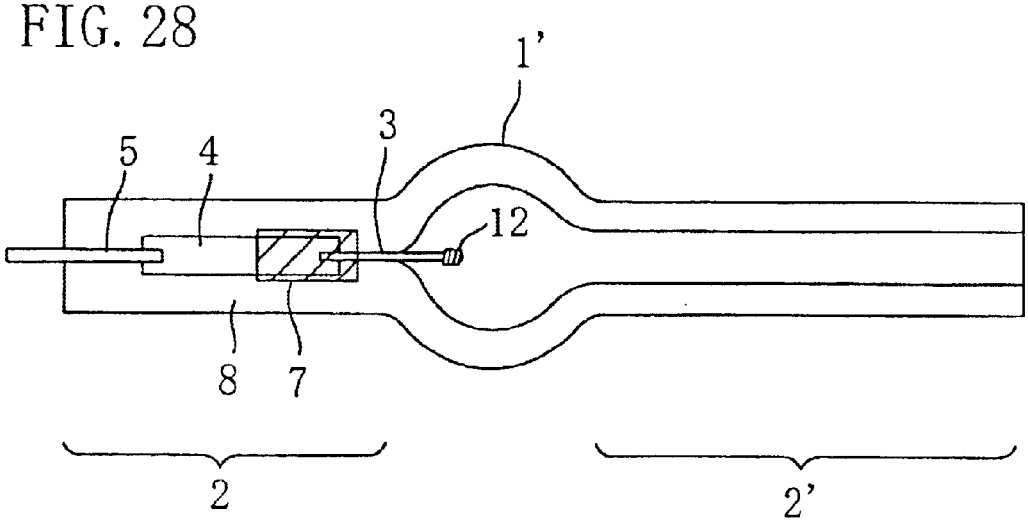
FIG. 28 is a schematic cross-sectional view showing the structure of a lamp when a withstand pressure test with hydrostatic pressure is performed.

Next, the strength against pressure of the lamps 100 and 200 will be described. FIG. 28 is a schematic view showing the lamp structure when a withstand pressure test is performed using hydrostatic pressure. For the withstand pressure test with hydrostatic pressure, as shown in FIG. 28, one sealing portion 2 has the same structure as that of the sealing portion 2 of the lamp 100 shown in FIG. 1 and the sealing portion 2 of the lamp 200 and 300 shown in FIGS. 26 and 27. The other sealing portion is in the state of the side tube portion 2', and water is poured from one end of the side tube portion 2' that is open to apply water pressure and thus the withstand pressure of the lamp is measured. More specifically, pure water is introduced from the open side tube portion 2', hydrostatic pressure is applied, and the pressure is gradually increased. The value of hydrostatic pressure when the lamp is broken is taken as the withstand pressure of the lamp (withstand pressure against hydrostatic pressure).

Figure 29:
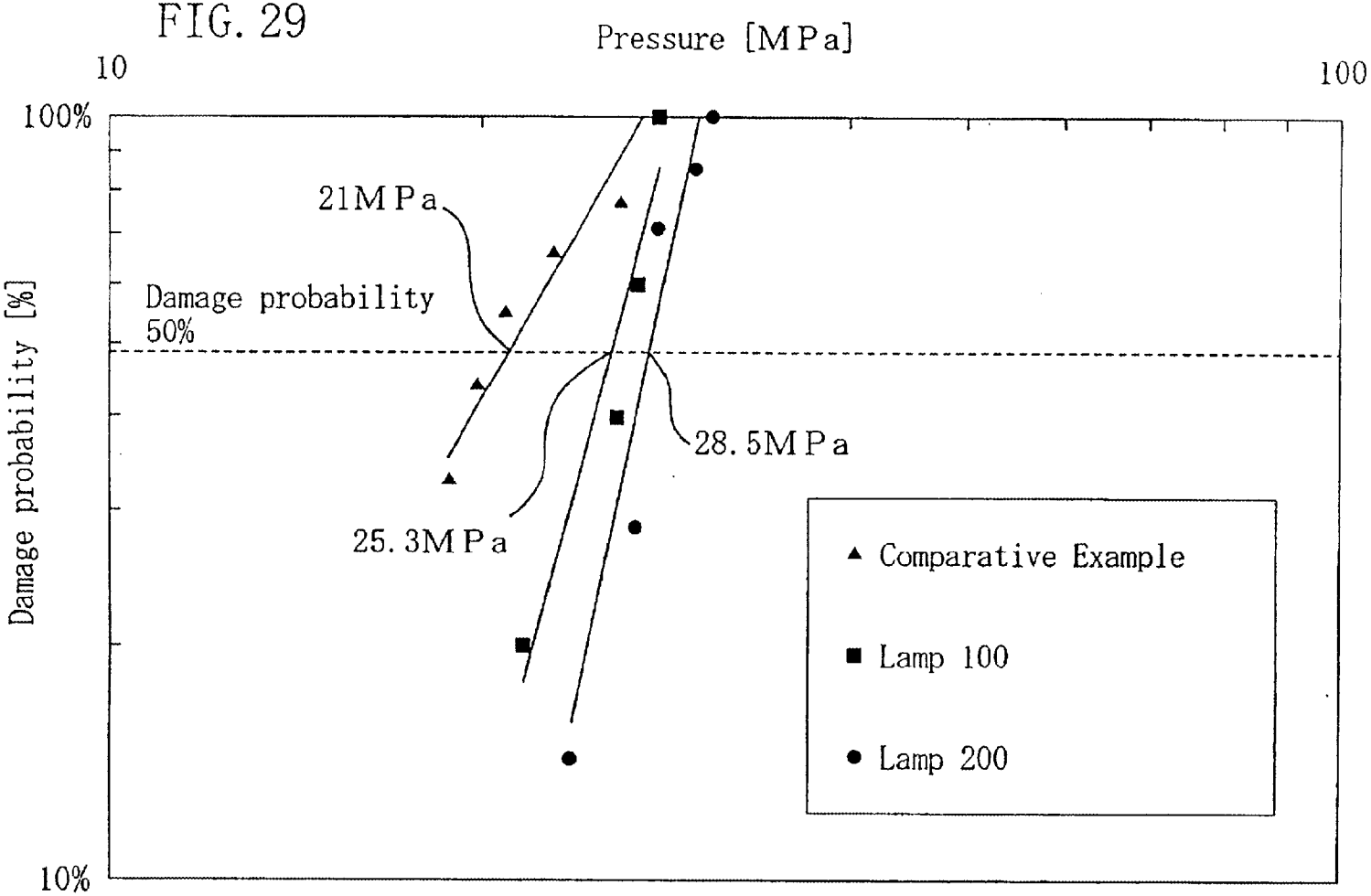
FIG. 29 is a Weibull plot showing the relationship between the strength against pressure and the damage probability.

FIG. 29 shows the results of the withstand pressure test with respect to seven lamps 100, five lamps 200, and nine comparative lamps (see FIG. 2B). FIG. 29 is a Weibull plot showing the relationship between the withstand pressure and the breakage probability. In FIG. 29, the larger value in the horizontal axis has the larger withstand pressure, and the larger inclination (i.e., the more vertical) has the smaller variation in the withstand pressure.

As seen from FIG. 29, the pressure at a breakage probability of 50% is 21 MPa for the comparative example, whereas it is 25.3 MPa for the lamp 100, and is as large as 28.5 MPa for the lamp 200. The withstand pressure (withstand pressure against hydrostatic pressure) of the lamps 100 and 200 is a high withstand pressure that cannot be reached even by a conventional lamp having excellent withstand pressure. As for the inclination, the lamps 100 and 200 of this embodiment have larger inclinations than that of the comparative example, which indicates that the variation is small.

In general, it is known that the operating pressure for lamp operation is higher than the withstand pressure obtained by the withstand pressure test. The reason why the operating pressure is higher is as follows. When a lamp is operated and heated, the glass of the luminous bulb is supposed to expand thermally, but in reality, the structure of the lamp prevents the glass of the luminous bulb from expanding freely. As a result, a contracting force is applied to the luminous bulb. Because of the action of this contracting force, that is, a restoring force, the operating pressure for lamp operation becomes higher than the withstand pressure obtained by the withstand pressure test. According to the evaluation of the operating pressure for lamp operation, the operating pressure for the lamp 100 can be 30 MPa or more, and that for the lamp 200 is as high as 40 MPa or more. On the other hand, when the operating pressure for the comparative lamp is increased to 30 MPa, the lamp will be broken.

A high pressure discharge lamp that operates at an operating pressure of 30 MPa has not existed before, so that the spectral characteristics at the time when the operating pressure is large attract considerable interest. It was evident that when the operating pressure was increased to 30 MPa or more, the average color rendering index Ra and the illuminance are improved significantly. The results will be described below.

Figure 30:
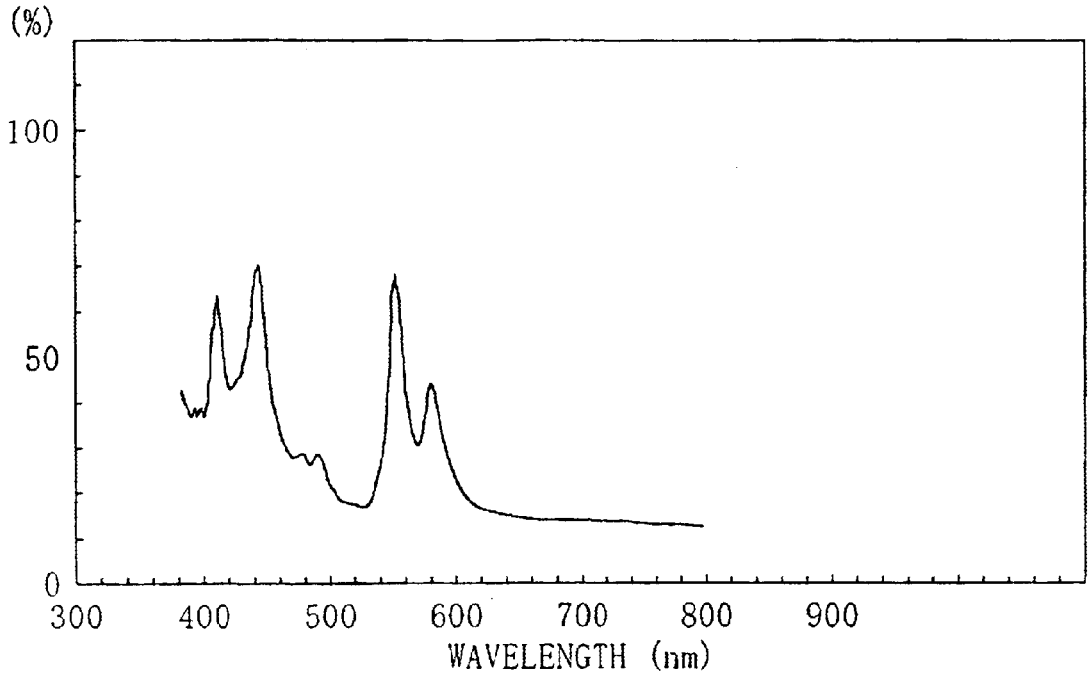
FIG. 30 is a graph showing spectral distribution when the lamp is operated at an operating pressure of 40 MPa.
Figure 31:
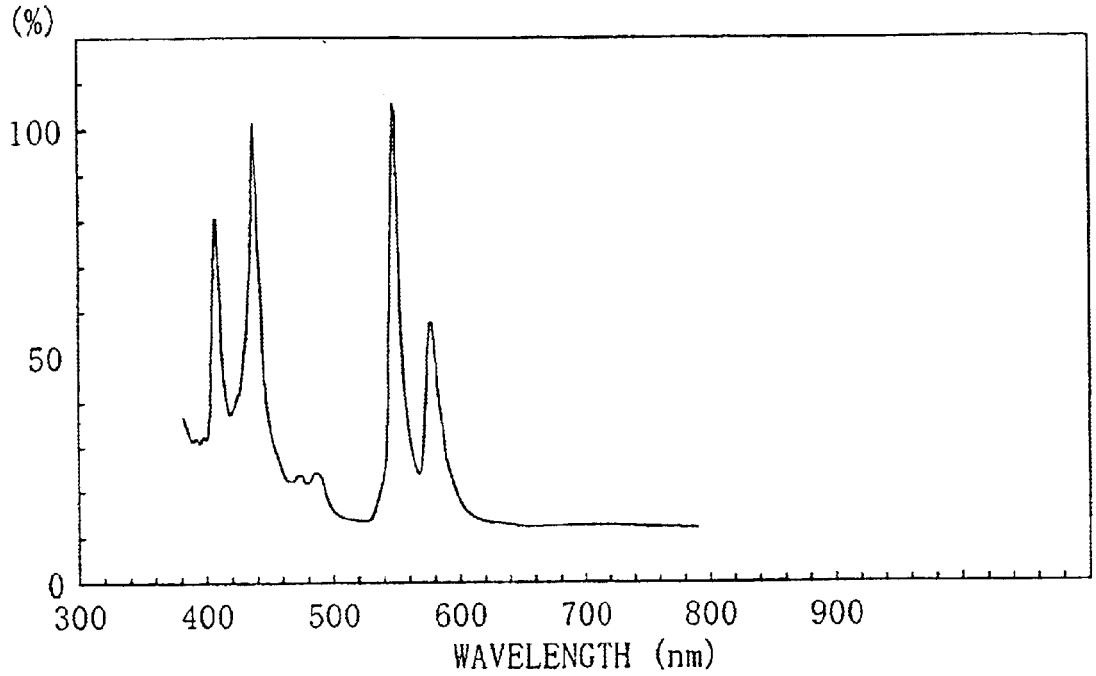
FIG. 31 is a graph showing spectral distribution when the lamp is operated at an operating pressure of 19 MPa.
Figure 32:
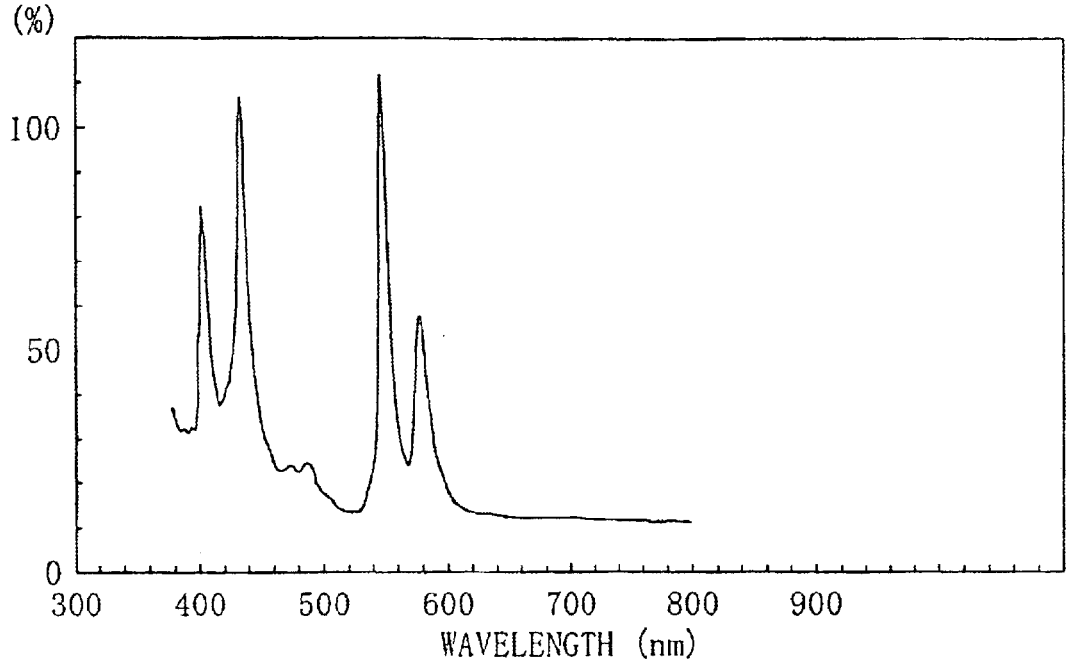
FIG. 32 is a graph showing spectral distribution of a conventional lamp.

FIG. 30 shows the spectral characteristics at the time when the lamp of this embodiment is operated at an operating pressure of 40 MPa. FIG. 31 shows the spectral characteristics at the time when the lamp of this embodiment is operated at an operating pressure of 19 MPa. On the other hand, FIG. 32 shows the spectral characteristics at the time when the conventional lamp (manufactured by Philips) is operated at 120 W and an operating pressure of 20 MPa for reference. The spectral characteristics shown in FIGS. 30 to 32 are data obtained by actual measurement.

In comparison with FIGS. 31 and 32, FIG. 30 indicates that the ratios of line spectrum in the vicinity of 405 nm, 436 nm, 546 nm, and 547 nm are small for the lamp at an operating pressure of 40 MPa. As for the average color rendering index Ra, in the example shown in FIG. 30, Ra was as high as 70.7. On the other hand, in the example shown in FIG. 31, Ra was 60.2. In the example shown in FIG. 32, Ra was 59.4. For reference, other characteristics of the examples shown in FIGS. 30 to 32 are as follows. R9 to R15 are special color rendering indexes.

Example shown in FIG. 30 (operating pressure of 40 MPa, Ra=70.7): chromaticity value (x, y)=(0.2935, 0.2967), Tc=8370K, $D_{uv}$=−3.4 R9=−11.0, R10=34.4, R11=56.7, R12=58.6, R13=66.3, R14=84.1, R15=66.8

Example shown in FIG. 31 (operating pressure of 19 MPa, Ra=60.2): chromaticity value (x, y)=(0.2934, 0.3030), Tc=8193K, $D_{uv}$=0.1 R9=−53.3, R10=11.6, R11=42.0, R12=41.9, R13=54.0, R14=79.0, R15=52.4

Example shown in FIG. 32 (operating pressure of 20 MPa, Ra=59.4): chromaticity value (x, y)=(0.2895, 0.3010), Tc=8574K, $D_{uv}$=1.3 R9=−53.2, R10=9.9, R11=40.9, R12=41.5, R13=52.8, R14=78.5, R15=50.8

Figure 33:
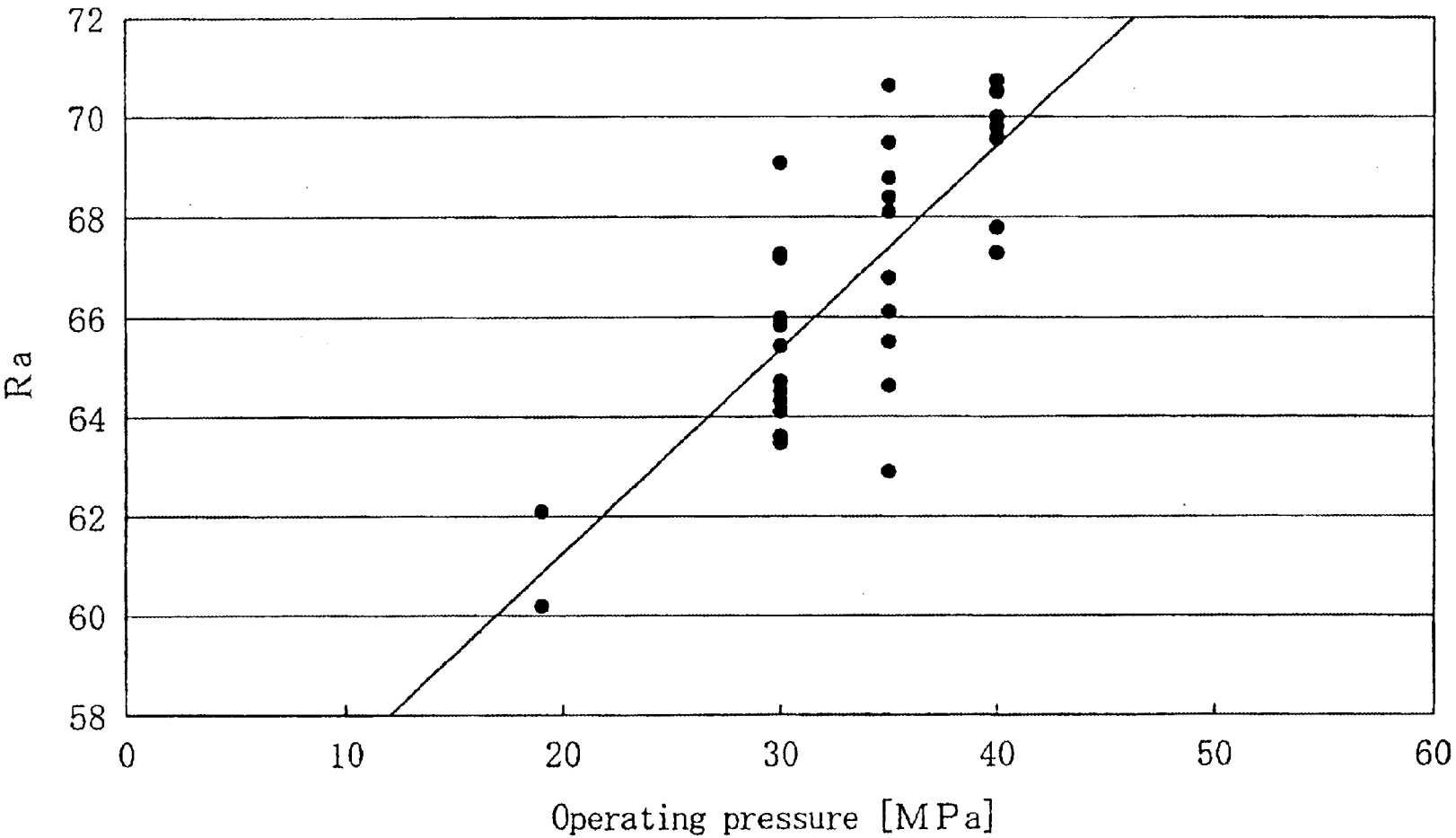
FIG. 33 is a graph showing the relationship between the average color rendering index Ra and the operating pressure.

Next, the relationship between the average color rendering index Ra and the operation pressure for lamp operation will be described. FIG. 33 is a graph showing the dependence of Ra on the operating pressure for lamp operation.

As seen from FIG. 33, as the operating pressure for lamp operation increases, Ra increases. When the operating pressure is increased from 19 MPa to 40 MPa, Ra is improved by about 14%. In the context that the Ra of conventional superhigh pressure mercury lamps is at most 60 (65 in some cases), if Ra can be increased to 65 or more, the application range of the lamp can be extended. More specifically, in the context that the Ra of a fluorescent lamp is 61 and the Ra of a high pressure mercury fluorescent lamp is 40 to 50, if the Ra of a superhigh pressure mercury lamp can be increased to be more than 65, the lamp also can be used positively for high efficient metal halide lamps (e.g., Ra 65 to 70). If the Ra of a superhigh pressure mercury lamp is increased to 70 or more, the lamp can be used not only for industrial work, but also can be used preferably in offices, so that the lamp can be used in a wide range of applications. Therefore, it is preferable that the average color rendering index Ra of the lamp of this embodiment is as high as possible, for example, a value larger than 65, or 67 or more, or 70 or more. The color temperature of this lamp (superhigh pressure mercury lamp is 8000 K or more, and a lamp having a color temperature of 8000 K or more and a Ra of more than 65 has not existed yet at present. The color temperature of a metal halide lamp having a very high Ra is relatively low and the color temperature of an incandescent lamp is also relatively low. The lamp of this embodiment having a color temperature of 8000 K or more and a Ra of more than 65 can be an artificial solar light source (artificial solar device or artificial solar system) or something similar, and thus this is an epoch-making lamp that can produce a new demand that has not existed yet today.

Furthermore, the lamp 100 and 200 of this embodiment can be formed into a lamp with a mirror or a lamp unit in combination with a reflecting mirror.

Figure 34:
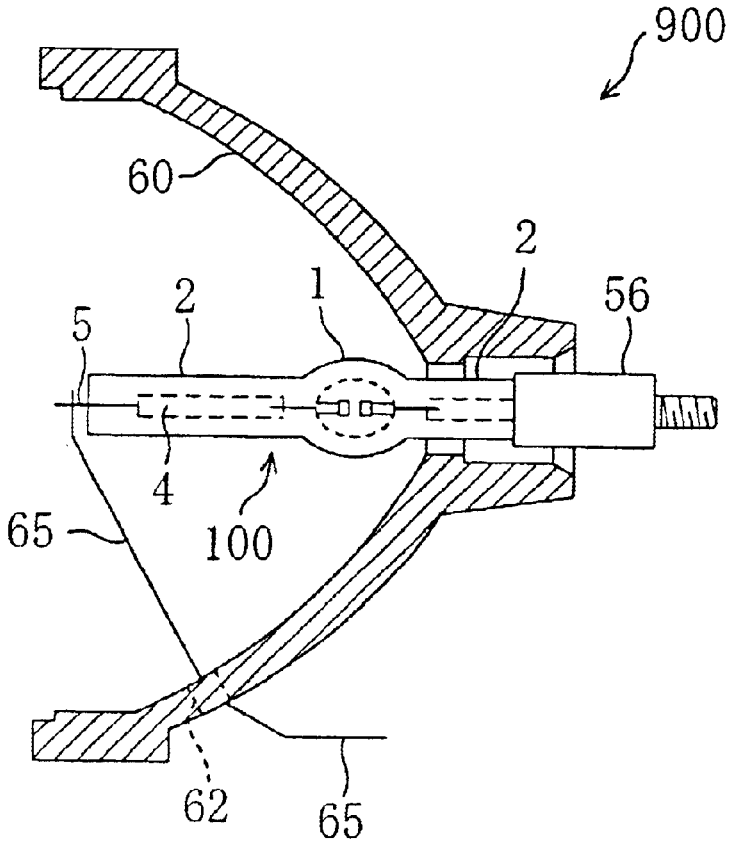
FIG. 34 is a schematic cross-sectional view showing the structure of a lamp 900 with a mirror.

FIG. 34 is a schematic cross-sectional view showing a lamp 900 with a mirror including the lamp 100 of this embodiment.

The lamp 900 with a mirror includes a spherical luminous bulb 1, a pair of sealing portions 2 and a reflecting mirror 60 for reflecting light emitted from the lamp 100. The lamp 100 is only an example, and the lamp 200 can be used as well. The lamp 900 with a mirror may further include a lamp housing for holding the reflecting mirror 60. The lamp with a mirror including a lamp housing is encompassed in a lamp unit.

The reflecting mirror 60 is configured so as to reflect radiated light from the lamp 100 such that the light becomes, for example, a parallel light flux, a condensed light flux converging a predetermined small region, or a divergent light flux equivalent to a light diverged from a predetermined small region. As the reflecting mirror 60, for example, a parabolic mirror or an ellipsoidal mirror can be used.

In this embodiment, a lamp base 56 is provided in one of the sealing portions 2 of the lamp 100, and the lamp base 56 and an external lead 5 extending from the sealing portion 2 are electrically connected. The sealing portion 2 and the reflecting mirror 60 are attached tightly with, for example, an inorganic adherent (e.g., cement) so as to be integrated into one unit. An extending lead wire 65 is electrically connected to the external lead 5 of the sealing portion 2 positioned on the side of the front opening of the reflecting mirror 60, and the extending lead wire 65 is extended from the lead wire 5 to the outside of the reflecting mirror 60 through an opening 62 for a lead wire of the reflecting mirror 60. For example, a front glass can be attached in the front opening of the reflecting mirror 60.

Such a lamp with a mirror or a lamp unit can be attached to an image projecting apparatus such as a projector employing liquid crystal or DMD, and can be used as a light source of an image projecting apparatus. Furthermore, an image projecting apparatus can be configured by combining such a lamp with a mirror or a lamp unit with an optical system including an image device (DMD (Digital Micromirror Device) panels or liquid crystal panels). For example, a projector (digital light processing (DLP) projectors) using DMDs or liquid crystal projectors (including reflective projectors using a LCOS (Liquid Crystal on Silicon) structure) can be provided. Furthermore, the lamp unit obtained by the production method of this embodiment can be used preferably, not only as a light source of an image projecting apparatus, but also for other applications, such as a light source for ultraviolet ray steppers or a light source for sport stadium, a light source for automobile headlights, and a floodlight for illuminating traffic signs.

Next, the relationship between the operating pressure for lamp operation and the illuminance in the lamp of this embodiment will be described.

Figure 35:
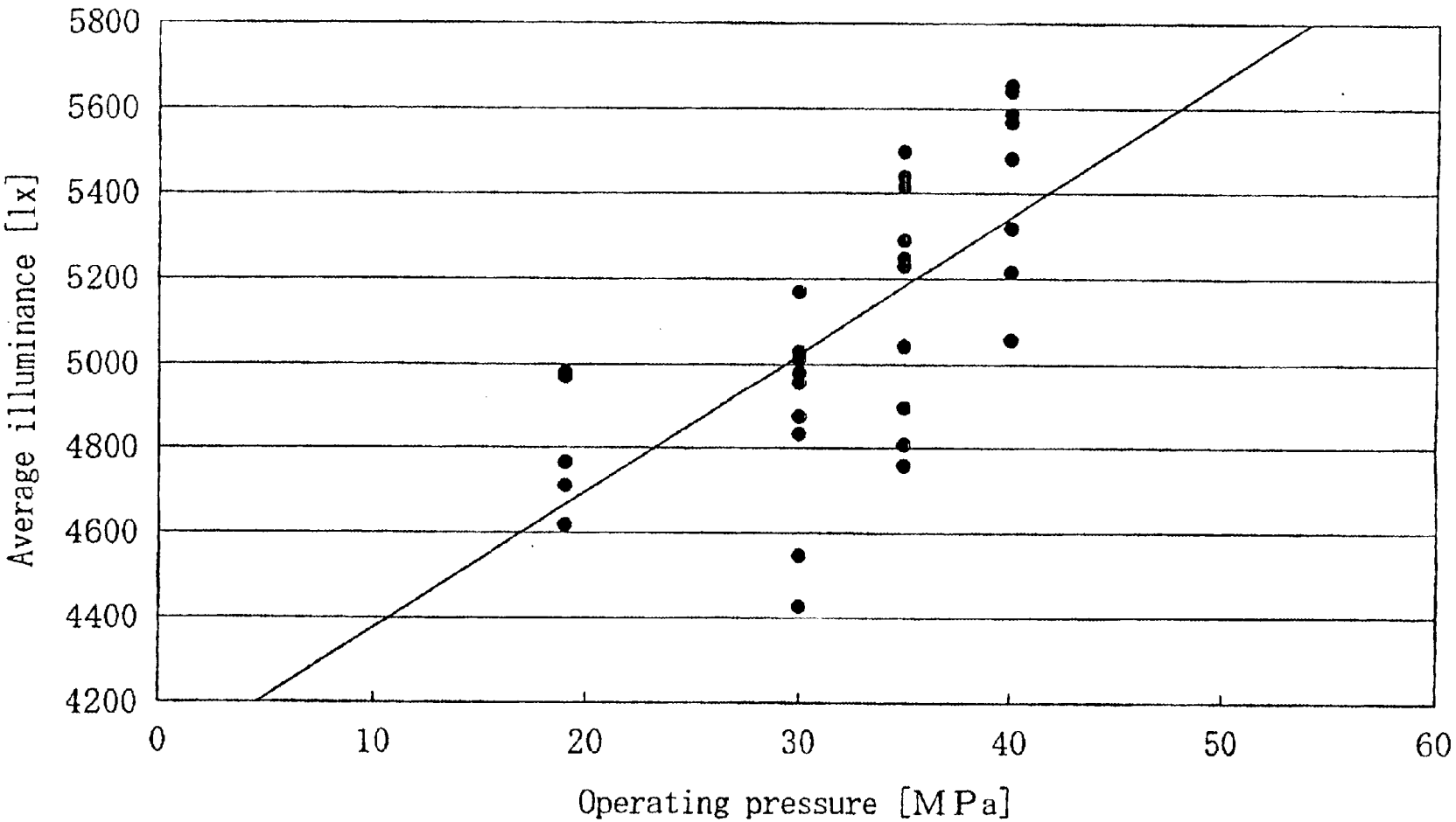
FIG. 35 is a graph showing the relationship between the operating pressure (MPa) and the average illuminance (1×).

FIG. 35 is a graph showing the relationship between the operating pressure (MPa) and the average illuminance (1×). The illuminance was measured in the following manner. The lamp was incorporated into the reflecting mirror shown in FIG. 34, a screen was divided into nine sections having an equal area while being irradiated with light with an appropriate optical system, and the illuminance was measured at the center of each section. The average of the nine illuminances was taken as an average illuminance and was used as the index of the illuminance of the lamp.

As seen from FIG. 35, as the operating pressure increases, the illuminance increases. When the operating pressure is increased from 19 MPa to 40 MPa, the illuminance is improved by about 14%. Therefore, if a lamp operating at 40 MPa is used, an image projecting apparatus that is brighter than conventional lamps can be realized. In recent years, there has been a greater demand for a brighter screen, so that improving the illuminance by about 14% can be a breakthrough of the existing techniques.

Other Embodiments

In the above embodiment, a mercury lamp using mercury as a luminous material has been described as one example of a high pressure discharge lamp, but the present invention can be applied to any high pressure discharge lamps having the structure in which the sealing portions (seal portions) maintain airtightness of the luminous bulb, for example, a high pressure discharge lamp such as a metal halide lamp enclosing a metal halide, or a xenon lamp. This is because in metal halide lamps or the like, it is preferable that the increased withstand pressure is better, that is to say, a high reliable lamp having a long life can be realized by preventing leakage or cracks.

If the structure of this embodiment is applied to a metal halide lamp enclosing, not only mercury, but also a metal halide, the following effect can be obtained. The attachment of the metal foil 4 in the sealing portion 2 can be improved by providing the second glass portion 7, so that a reaction between the metal foil 4 and a metal halide (or halogen or an alkali metal) can be suppressed, and therefore the reliability of the structure of the sealing portion can be improved. In particular, in the case where the second glass portion 7 is positioned in a portion of the metal rod 3, as the structure shown in FIGS. 1, 8 and 10, it is possible to reduce effectively penetration of a metal halide that causes embrittlement of the foil by reacting with the metal foil 4 after otherwise entering from a small gap between the metal rod 3 and the glass of the sealing portion 2. Thus, the structure of the above-embodiment can be applied preferably to a metal halide lamp.

In recent years, a mercury-free metal halide lamp has been under development, and the technique of the above embodiment can be applied to a mercury-free metal halide lamp. This will be described in greater detail below.

An example of the mercury-free metal halide lamp to which the present invention is applied is a lamp having the structure shown in FIGS. 26 and 27, but not substantially enclosing mercury and enclosing at least a first halogenide, a second halogenide and rare gas. The metal of the first halogenide is a luminous material, and the second halogenide has a vapor pressure higher than that of the first halogenide, and is a halogenide of one or more metals that emit light in a visible light region with more difficulty than the metal of the first halogenide. For example, the first halogenide is a halogenide of one or more metals selected from the group consisting of sodium, scandium, and rare earth metals. The second halogenide has a relatively larger vapor pressure and is a halogenide of one or more metals that emit light in a visible light region with more difficulty than the metal of the first halogenide. More specifically, the second halogenide is a halogenide of at least one metal selected from the group consisting of Mg, Fe, Co, Cr, Zn, Ni, Mn, Al, Sb, Be, Re, Ga, Ti, Zr, and Hf. The second halogenide containing at least a halogenide of Zn is more preferable.

Another combination example is as follows. In a mercury-free metal halide lamp including a translucent luminous bulb (airtight vessel) 1, a pair of electrodes 3 provided in the luminous bulb 1, and a pair of sealing portion 2 coupled to the luminous bulb 1, $ScI_3$ (scandium iodide) and NaI (sodium iodide) as luminous materials, $InI_3$ (indium iodide) and TlI (thallium iodide) as alternative materials to mercury, and rare gas (e.g., Xe gas at 1.4 MPa) as starting aid gas are enclosed in the luminous bulb 1. In this case, the first halogenide is constituted by $ScI_3$ (scandium iodide) and NaI (sodium iodide), and the second halogenide is constituted by $InI_3$ (indium iodide) and TlI (thallium iodide). The second halogenide can be any halogenide, as long as it has a comparatively high vapor pressure and can serve as an alternative to mercury, and therefore, for example, an iodide of Zn can be used, instead of $InI_3$ (indium iodide).

The reason why the technique of Embodiment 1 can be applied preferably to such a mercury-free metal halide lamp will be described below.

First, the efficiency of a mercury-free metal halide lamp employing an alternative substance of Hg (halogenide of Zn) is lower than that of a lamp containing mercury. In order to increase the efficiency, it is very advantageous to increase the operating pressure for lamp operation. The lamp of the above embodiment has a structure that improves the withstand pressure, so that a rare gas can be enclosed to a high pressure, and therefore the efficiency can be improved easily. Thus, a mercury-free metal halide lamp that can be put to practical use can be realized easily. In this case, Xe having a low thermal conductivity is preferable as the rare gas.

In the case of a mercury-free metal halide lamp, since mercury is not enclosed, it is necessary to enclose halogen in a larger amount than in the case of a metal halide lamp containing mercury. Therefore, the amount of halogen that reaches the metal foil 4 through a gap near the electrode rod 3 is increased, and the halogen reacts the metal foil 4 (the base portion of the electrode rod 3 in some cases). As a result, the sealing portions structure becomes weak, and leakage tends to occur. In the structures shown in FIGS. 26 and 27, the surface of the electrode rod 3 is coated with the metal film 30 (or the coil 40), so that the reaction between the electrode rod 3 and the halogen can be prevented effectively. As shown in FIG. 1, in the case of the structure in which the second glass portion 7 is positioned around the electrode rod 3, the second glass portion 7 can prevent the halogenide (e.g., a halogenide of Sc) from penetrating. Thus, it is possible to prevent leakage from occurring. Therefore, the mercury-free metal halide lamp having the above-described structure has a higher efficiency and a longer life than those of conventional mercury-free metal halide lamp. This can be said widely for lamps for general illumination. For lamps for headlight of automobiles, the following advantage can be provided.

There is a demand for 100% light at the moment when a switch is turned on in the case of a headlight of an automobile. In order to meet this demand, it is effective to enclose a rare gas (specifically, Xe) to a high pressure. However, if Xe is enclosed to a high pressure in a regular metal halide lamp, the possibility of breakage is high. This is not preferable as a lamp for a headlight for which higher security is required. This is because the malfunction of a headlight at night leads to a car accident. The mercury-free metal halide lamp having the structure of the above embodiment has an improved withstand pressure, so that even if Xe is enclosed to a high pressure, the operation start properties can be improved while ensuring security. In addition, it has a long life, so that it is used more preferably for a headlight.

Furthermore, in the above embodiment, the case where the mercury vapor pressure is about 20 MPa and 30 MPa or more (the case of a so-called superhigh pressure mercury lamp) has been described, but this does not eliminate the application of the above embodiment to a high pressure mercury lamp having a mercury vapor pressure of about 1 MPa. The present invention can be applied to general high pressure discharge lamps including superhigh pressure mercury lamps and high pressure mercury lamps. It should be noted that the mercury vapor pressure of a lamp called a superhigh pressure mercury lamp is 15 MPa or more (the amount of mercury enclosed is 150 mg/cc or more) at present.

The fact that stable operation can be achieved at a very high operating pressure means high reliability of the lamp, so that when the structure of this embodiment is applied to a lamp having a not very high operating pressure (the operating pressure of the lamp is less than about 30 MPa, e.g., about 20 MPa to 1 MPa), the reliability of the lamp operating at that operating pressure can be improved.

A technical significance of a lamp that can realize a high strength against pressure will be further described below. In recent years, in order to obtain a high output and high power high pressure mercury lamp, a short arc type mercury lamp having a short arc length (interelectrode distance D) (e.g., D is 2 mm or less) has been under development. In the case of the short arc type lamp, it is necessary to enclose a larger amount of mercury than usual in order to suppress the evaporation of the electrode from being speeded up due to an increase of current. As described above, in the conventional structure, there was the upper limitation on the strength against pressure, so that there was also the upper limitation of the amount of mercury to be enclosed (e.g., about 200 mg/cc or less). Therefore, there was a limitation on the realization of the lamp exhibiting better characteristics. The lamp 100 of this embodiment can eliminate such a conventionally present limitation, and can promote the development of the lamp exhibiting excellent characteristics that could not be realized in the past. The lamp 100 of this embodiment makes it possible to realize a lamp having an amount of mercury to be enclosed of more than about 200 mg/cc or about 300 mg /cc or more.

The technology that can realize an amount of mercury to be enclosed of about 300 to 400 mg/cc or more (operating pressure for lamp operation of 30 to 40 MPa) has a significance that the security and reliability of a lamp of a level exceeding the operating pressure for lamp operation of 20 MPa (that is, a lamp having an operating pressure exceeding current 15 to 20 MPa, for example a lamp with 23 MPa or more or 25 MPa or more) can be guaranteed. In the case of mass production of lamps, it is inevitable that there are variations in the characteristics of the lamps, so that it is necessary to ensure the withstand pressure with consideration for the margin, even for a lamp having a light operating pressure of about 23 MPa. Therefore, the technology that can achieve a withstand pressure of 30 MPa also provides a large advantage to lamps having a withstand pressure of less than 30 MPa from the viewpoint that products can be actually supplied. If lamps with 23 MPa or even lower are produced utilizing the technology that can achieve a withstand pressure of 30 MPa, the security and the reliability can be improved.

Therefore, the structure of this embodiment also can improve the lamp characteristics in terms of reliability. In the lamp of the above embodiment, the sealing portion 2 is produced by a shrinking technique, but it can be produced by a pinching technique. Also, a double end type high pressure discharge lamp has been described, but the technique of the above embodiment can be applied to a single end type discharge lamp. In the above embodiment, the second glass portion is formed of the glass tube 70 made of, for example, Vycor, but it does not have to be formed of a glass tube. The glass tube does not have to be used, as long as it is a glass structure that is in contact with the metal foil 4 and can let a compressive stress present in a portion of the sealing portion 2, even if the entire circumference of the metal foil 4 is not covered. For example, a glass structure that has a slit in a portion of the glass tube 70 and has a C shape can be used, and for example, carats (glass pieces) made of Vycor can be disposed in contact with one side or both sides of the metal foil 4. Alternatively, for example, a glass fiber made of Vycor can be disposed so as to cover the circumference of the metal foil 4. However, when glass powder, for example, a sintered glass material formed by compressing and sintering glass powder, is used instead of the glass structure, a compressive stress cannot be present in a portion of the sealing portion 2. Therefore, glass powder cannot be used.

In addition, the distance (arc length) between the pair of electrodes 3 can be a distance of a short arc type or can be longer than that. The lamp of the above embodiment can be used as either of an alternating current operation type and a direct current operation type. Furthermore, the structures shown in the above embodiment and the modified examples can be used mutually. The sealing portion structure including the metal foil 4 has been described, but it is possible to apply the structure of the above embodiment to a sealing portion structure without a foil. Also in the sealing portion structure without a foil, it is important to increase the withstand pressure and the reliability. More specifically, one electrode rod (tungsten rod) 3 is used as the electrode structure 50, without using the molybdenum 4. The second glass portion 7 is disposed at least in a portion of that electrode rod 3, and the first glass portion 8 is formed so as to cover the second glass portion 7 and the electrode rod 3. Thus, a sealing portion structure can be constructed. In this case of this structure, the external lead 5 can be constituted by the electrode rod 3.

Figure 36:
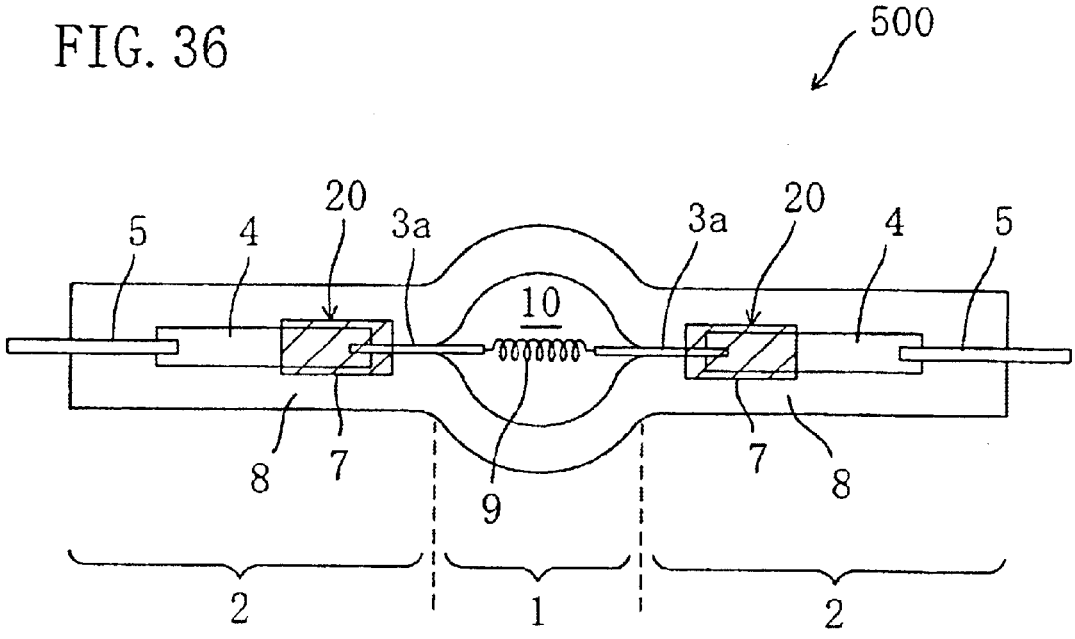
FIG. 36 is a schematic cross-sectional view showing the structure of an incandescent lamp 500.
Figure 37:
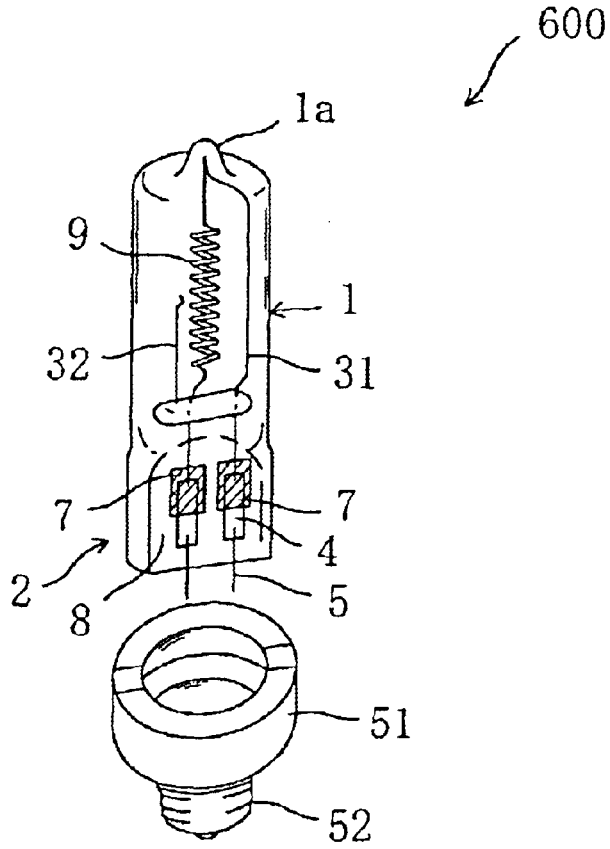
FIG. 37 is a perspective view showing the structure of an incandescent lamp 600.

In the above-described embodiment, discharge lamps have been described, but the technique of Embodiment 1 is not limited to the discharge lamps, and can be applied to any lamps other than discharge lamps (e.g., incandescent lamps), as long as they can retain the airtightness of the luminous bulb by the sealing portions (seal portions). FIGS. 36 and 37 show incandescent lamps to which the technique of Embodiment 1 is applied.

An incandescent lamp 500 shown in FIG. 36 is a double end type incandescent lamp (e.g., a halogen incandescent lamp) provided with a filament 9 in the luminous bulb 1. The filament 9 is connected to an inner lead (internal lead wire) 3*a*. An anchor can be provided in the luminous bulb 1.

An incandescent lamp 600 shown in FIG. 37 is a single end type incandescent lamp, as seen from FIG. 37. In this example, a single end type halogen incandescent lamp is shown. The incandescent lamp 600 includes, for example, a quartz glass globe 1, a sealing portion 2 (a first glass portion 8, a second glass portion 7, and a molybdenum foil 4), a filament 9, an inner lead 31, an anchor 32, an outer lead (external lead wire) 5, an insulator 51 and a lamp base 52. For such a halogen incandescent lamp as well, breakage is a very important issue to be addressed, so that the technique of Embodiment 1 that prevents breakage has a large technical significance.

The preferable embodiments have been described above, but the description above is not limiting, and various modifications can be made.

Figure 38:
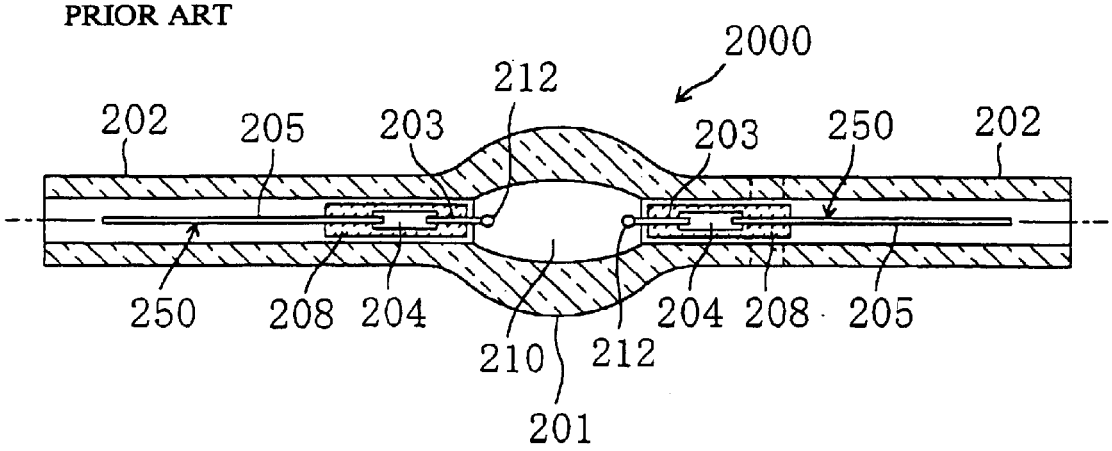
FIG. 38 PRIOR ART
FIG. 38 is a schematic cross-sectional view showing the structure of a conventional lamp 2000.
Figure 39:
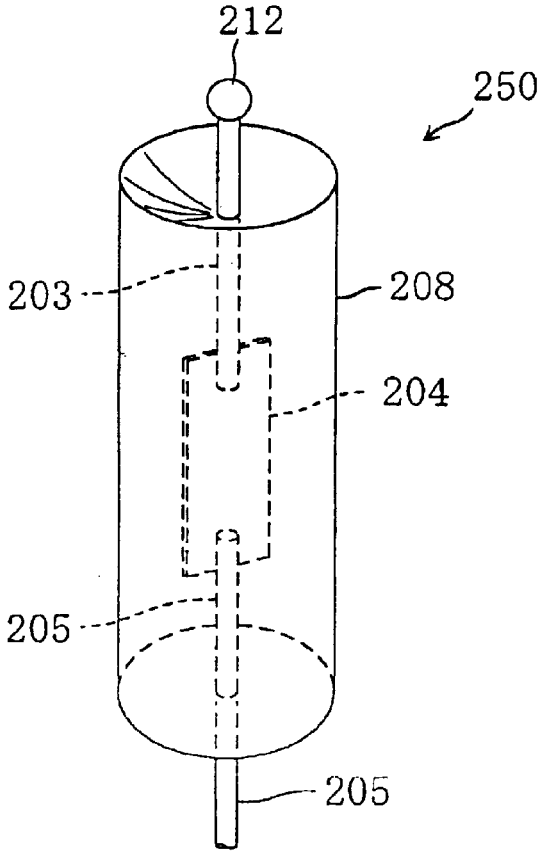
FIG. 39 is an enlarged view of the principal part of a conductive lead wire structure 250.
Figure 40:
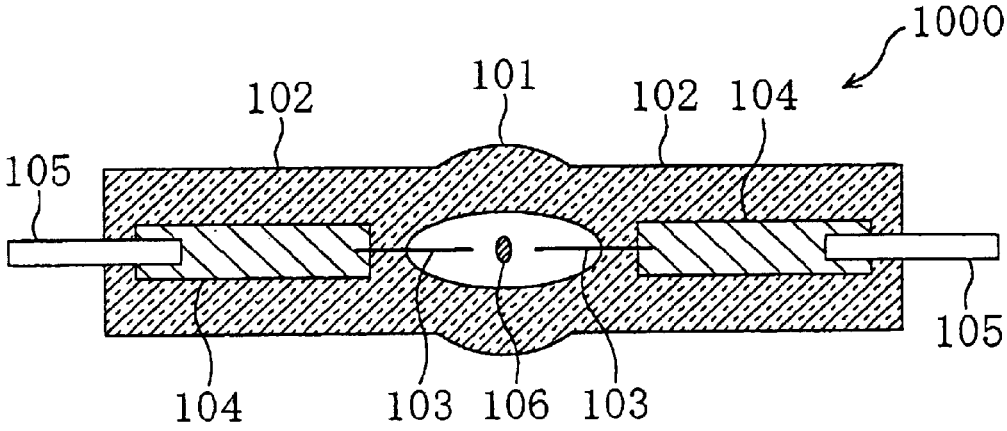
FIG. 40 PRIOR ART
FIG. 40 is a schematic cross-sectional view showing the structure of a conventional high pressure mercury lamp.

The following examples are known techniques that attempt to improve the structure of the sealing portion. FIGS. 38 and 39 show a lamp 2000 disclosed in Japanese Laid-Open Patent Publication No. 6-208831 (corresponding to U.S. Pat. No. 5,468,168). The lamp 2000 aims at improving the airtightness and supporting means of a lead wire for precise positioning of the luminous means of the lamp.

The lamp 2000 shown in FIG. 38 includes an envelope 201 made of quartz glass enclosing an internal space 210 for light generation, and a conductive lead wire structure 250 that projects to the internal space 210. FIG. 39 is an enlarged view showing the structure of the conductive lead wire structure 250.

The conductive lead wire structure 250 includes an electrode rod 203 having a head 212, a metal foil 204 and an external lead wire 205, and these components are enclosed by a body portion 207 formed by compressing and sintering vitreous material particles, and thus is sealed airtightly. This body portion 208 extends through the opening of the envelope 201 in communication with the internal space 210 so that an airtight portion is formed in an interface region between the envelope 201 and the body portion 208.

In this lamp 2000, the body portion 207 formed by compressing and sintering vitreous material particles is positioned inside a foot portion 202 and thus the opening of the envelop 201 is sealed airtightly, and is not like the lamp 100 of this embodiment, which has a structure in which the sealing portion including the second glass portion 7 having a compressive strain is provided. Therefore, the two structures are different in the basic structure.

More specifically, in the lamp 2000, the body portion 207 is formed of molten silica powder, and the foot portion 202 is formed of molten quartz so that the thermal expansion coefficients of the two portions are substantially equal. In this case, the two portions have substantially the same composition, and therefore a compressive strain does not occur in the body portion 207. This publication also discloses an approach of producing the body portion 207 with a porous mother material of a vitreous material such as Vycor glass sintered quartz, but even if such a body portion 207 with a porous mother material of a vitreous material such as Vycor glass sintered quartz is provided inside the foot portion 202, there is no reasonable explanation as to why a compressive strain in the electrode axis direction remains in the body portion 207, and actually there is no description or suggestion that a compressive strain remains in the body portion 207 of the lamp 2000 disclosed in the publication.

The above publication teaches that the thermal expansion coefficient of the body portion 207 is matched to those of the surroundings thereof for reliable airtightness, so that this seems to mean that it is preferable that the composition of the body portion 207 is as close to those of the surroundings thereof as possible. Even if vitreous material particles are compressed and sintered, and a glass portion is disposed on the side of the center and is shrunk with the side tube portion 2' of this embodiment from the outside, in the sintered material constituted by compressed particles, the particles are dispersed so that sintered glass powder is dispersed to the glass portion of the side tube portion 2' with a concentration gradient, contrary to letting compressive strain (compressive stress) remain.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A high pressure discharge lamp comprising:

a luminous bulb enclosing a luminous substance therein; and a sealing portion for retaining airtightness of the luminous bulb;

wherein the sealing portion has a first glass portion extending from the luminous bulb and a second glass portion provided at least in a portion inside the first glass portion, and the sealing portion has a portion to which a compressive stress remains, and wherein the compressive stress in the portion to which the compressive stress is applied is about 10 kgf/cm$^2$ or more and about 50 kgf/cm$^2$ or less.

2. The high pressure discharge lamp according to claim 1, wherein the portion to which a compressive stress is applied is one selected from the group consisting of the second glass portion, a boundary portion of the second glass portion and the first glass portion, a portion of the second glass portion on a side of the first glass portion, and a portion of the first glass portion on a side of the second glass portion.

3. The high pressure discharge lamp according to claim 1, wherein a strain boundary region caused by a difference in compressive stress between the first glass portion and the second glass portion is present in a vicinity of a boundary of the two glass portions.

4. The high pressure discharge lamp according to claim 1, wherein a metal portion for supplying power that is in contact with the second glass portion is provided in the sealing portion.

5. The high pressure discharge lamp according to claim 1, wherein the compressive stress is applied at least in a longitudinal direction of the sealing portion.

6. The high pressure discharge lamp according to claim 1, wherein the first glass portion contains 99 wt % or more of $SiO_2$, and the second glass portion contains $SiO_2$ and at least one of 15 wt % or less of $Al_2O_3$ and 4 wt % or less of B.

7. The high pressure discharge lamp according to claim 1, wherein a softening point of the second glass portion is lower than that of the first glass portion.

8. The high pressure discharge lamp according to claim 1, wherein the second glass portion is formed of a glass tube.

9. The high pressure discharge lamp according to claim 1, wherein the second glass portion is not formed by compressing and sintering glass powder.

10. The high pressure discharge lamp according to claim 1, wherein a pair of the sealing portions extend from the luminous bulb, each of the pair of sealing portions has the first glass portion and the second-glass portion, and each of the pair of sealing portions has a portion to which a compressive stress is applied.

11. The high pressure discharge lamp according to claim 3, wherein the difference in the compressive stress is about 10 kgf/cm$^2$ or more and about 50 kgf/cm$^2$ or less.

12. The high pressure discharge lamp according to claim 1, wherein a pair of electrode rods are opposed in the luminous bulb, at least one of the pair of electrode rods is connected to a metal foil, and the metal foil is provided in the sealing portion, and at least a portion of the metal foil is positioned in the second glass portion.

13. The high pressure discharge lamp according to claim 12, wherein at least mercury is enclosed in the luminous bulb as the luminous substance, and an amount of the mercury enclosed is 300 mg/cc or more.

14. The high pressure discharge lamp according to claim 13, which is a high pressure mercury lamp having an average color rendering index Ra of more than 65.

15. The high pressure discharge lamp according to claim 13, wherein a color temperature of the high pressure mercury lamp is 8000 K or more.

16. The high pressure discharge lamp according to claim 1, which is a metal halide lamp containing at least a metal halide as the luminous substance.

17. A high pressure discharge lamp comprising:

a luminous bulb in which a pair of electrode rods are disposed in an inside of the bulb; and a pair of sealing portions for retaining airtightness of the luminous bulb that extend from the luminous bulb;

wherein a portion of each of the pair of electrode rods is buried in a corresponding sealing portion of the pair of sealing portions, the sealing portion has a first glass portion extending from the luminous bulb and a second glass portion provided at least in a portion inside the first glass portion, and at least one of the sealing portions has a portion to which a compressive stress is applied, the portion to which a compressive stress is applied is one selected from the group consisting of the second glass portion, a boundary portion of the second glass portion and the first glass portion, a portion of the second glass portion on a side of the first glass portion, and a portion of the first glass portion on a side of the second glass portion, the compressive stress at least in a longitudinal direction of the sealing portion is present in the second glass portion, and a metal film made of at least one metal selected from the group consisting of Pt, Ir, Rh, Ru, and Re is formed on a surface of at least a portion of the electrode rod that is buried in the at least one of the sealing portions, and wherein the compressive stress in the portion to which the compressive stress is applied is about 10 kgf/cm$^2$ or more and about 50 kgf/cm$^2$ or less.

18. A high pressure discharge lamp comprising:

a luminous bulb in which a pair of electrode rods are disposed in an inside of the bulb; and a pair of sealing portions for retaining airtightness of the luminous bulb that extend from the luminous bulb;

wherein a portion of each of the pair of electrode rods is buried in a corresponding sealing portion of the pair of sealing portions, at least one of the sealing portions has a first glass portion extending from the luminous bulb and a second glass portion provided at least in a portion inside the first glass portion, and the at least one of the sealing portions has a portion to which a compressive stress is applied, the portion to which a compressive stress is applied is one selected from the group consisting of the second glass portion, a boundary portion of the second glass portion and the first glass portion, a portion of the second glass portion on a side of the first glass portion, and a portion of the first glass portion on a side of the second glass portion, and a coil having at least one metal selected from the group consisting of Pt, Ir, Rh, Ru, and Re on at least a surface thereof is wound around at least a portion of the electrode rod that is buried in the at least one of the sealing portions, and wherein the compressive stress in the portion to which the compressive stress is applied is about 10 kgf/cm$^2$ or more and about 50 kgf/cm$^2$ or less.

19. The high pressure discharge lamp according to claim 17 or 18, wherein each of the pair of electrode rods is connected to a metal foil provided inside a corresponding sealing portion of the pair of sealing portions, and at least a portion of a metal foil provided inside the at least one of the sealing portions is positioned in the second glass portion.

20. The high pressure discharge lamp according to claim 17 or 18, wherein the second glass portion contains $SiO_2$ and at least one of 15 wt % or less of $Al_2O_3$ and 4 wt % or less of B, the first glass portion contains 99 wt % or more of $SiO_2$, a softening point of the second glass portion is lower than that of the first glass portion, and the second glass portion is not formed by compressing and sintering glass powder.

21. The high pressure discharge lamp according to claim 17 or 18, wherein at least mercury is enclosed in the luminous bulb as the luminous substance, and an amount of the mercury enclosed is 300 mg/cc or more.

22. The high pressure discharge lamp according to claim 17 or 18, which is a metal halide lamp containing at least a metal halide as the luminous substance.

23. A high pressure discharge lamp comprising:

a luminous bulb enclosing a luminous substance therein; and a sealing portion for retaining airtightness of the luminous bulb;

wherein the sealing portion has a first glass portion extending from the luminous bulb and a second glass portion provided at least in a portion inside the first glass portion, and when a strain measurement is performed by a sensitive color plate method utilizing a photoelasticity effect is performed, a compressive stress is observed at least in a portion of a region corresponding to the second glass portion of the sealing portion, and wherein the compressive stress in the portion to which the compressive stress is applied is about 10 kgf/cm$^2$ or more and about 50 kgf/cm$^2$ or less.

24. A lamp unit comprising the high pressure discharge lamp according to claim 1, 17, 18, or 23, and a reflecting mirror for reflecting light emitted from the high pressure discharge lamp.

* * * * *